US006463773B1

(12) United States Patent
Dimig

(10) Patent No.: US 6,463,773 B1
(45) Date of Patent: Oct. 15, 2002

(54) ELECTRONIC LATCH APPARATUS AND METHOD

(75) Inventor: Steven J. Dimig, Plymouth, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/263,415

(22) Filed: Mar. 5, 1999

(51) Int. Cl.[7] ..... E05B 47/00

(52) U.S. Cl. ..... 70/277; 70/218; 292/201; 292/216; 292/DIG. 27

(58) Field of Search ..... 292/DIG. 27, 201, 292/216, DIG. 23; 70/277, 278.7, 279.1, 149, 218, 472

(56) References Cited

U.S. PATENT DOCUMENTS

| | | | | |
|---|---|---|---|---|
| 2,955,864 A | * | 10/1960 | Van Voorhees | 292/DIG. 27 X |
| 3,121,580 A | * | 2/1964 | Di Salvo et al. | 292/DIG. 27 X |
| 4,289,342 A | | 9/1981 | Bemm et al. | 292/49 |
| 4,386,798 A | * | 6/1983 | Ménard | 292/DIG. 27 X |
| 5,308,128 A | * | 5/1994 | Portelli et al. | 292/DIG. 27 X |
| 5,350,206 A | | 9/1994 | Akahori et al. | 292/336.3 |
| 5,531,488 A | | 7/1996 | Yoshikuwa et al. | 292/216 |
| 5,538,298 A | * | 7/1996 | Ikeda | 292/DIG. 27 X |
| 5,603,539 A | | 2/1997 | Gruhn et al. | 292/216 |
| 5,676,003 A | * | 10/1997 | Ursel et al. | 70/264 X |
| 5,881,589 A | | 3/1999 | Clark et al. | 70/283 X |
| 5,931,034 A | * | 8/1999 | Fisher | 70/264 |
| 5,992,194 A | * | 11/1999 | Baukholt et al. | 70/264 X |
| 6,079,237 A | | 6/2000 | Hochart | 70/278.6 |
| 6,254,148 B1 | | 7/2001 | Cetnar | 292/201 |
| 6,286,878 B1 | | 9/2001 | Hochart et al. | 292/216 |

FOREIGN PATENT DOCUMENTS

| | | | | |
|---|---|---|---|---|
| DE | 355578 | * | 6/1922 | 292/DIG. 27 |
| DE | 538812 | * | 11/1929 | 292/DIG. 27 |
| DE | 685943 | * | 12/1939 | 292/DIG. 27 |
| DE | 195 47 727 A1 | | 6/1997 | |
| DE | 297 01 390 | | 11/1997 | |
| EP | 285412 | | 10/1988 | |
| EP | 0743413 | | 11/1996 | |
| FR | 2746840 | | 10/1997 | |
| GB | 5427 | * | of 1911 | 292/DIG. 27 |
| IT | 413637 | * | 5/1946 | 292/DIG. 27 |

* cited by examiner

*Primary Examiner*—Lloyd A. Gall
(74) *Attorney, Agent, or Firm*—Michael Best & Friedrich LLP

(57) ABSTRACT

A latch assembly, comprising a control element having a pivot point and an actuator. The actuator has a first position in which the control element is engaged by the actuator for pivotal movement about the pivot point and a second position in which the control element is disengaged by the actuator from pivotal movement about the pivot point. The latch assembly further includes a ratchet arranged and configured for rotation with the control element when the control element is engaged by the actuator and for non-rotation when the control element is disengaged by the actuator. A highly preferred embodiment of the invention includes an automatic unlocking circuit powered by a backup power source.

28 Claims, 16 Drawing Sheets

ELECTRONIC LATCH APPARATUS AND METHOD

FIELD OF THE INVENTION

The present invention relates to latches and latching methods, and more particularly to devices and methods for electronically controlling and switching a latch between latched and unlatched states.

BACKGROUND OF THE INVENTION

Conventional latches are used to restrain the movement of one member or element with respect to another. For example, conventional door latches restrain the movement of a door with respect to a surrounding door frame. The function of such latches is to hold the door secure within the frame until the latch is released and the door is free to open. Existing latches typically have mechanical connections linking the latch to actuation elements such as handles which can be actuated by a user to release the latch. Movement of the actuation elements is transferred through the mechanical connections and will cause the latch to release. The mechanical connections can be one or more rods, cables, or other suitable elements or devices. Although the following discussion is with reference to door latches (e.g., especially for vehicle doors), the background information provided applies equally to a wide variety of latches used in other applications.

Most current vehicle door latches contain a restraint mechanism for preventing the release of the latch without proper authorization. When in a locked state, the restraint mechanism blocks or impedes the mechanical connection between the handle and a latch release mechanism, thereby locking the door. Many conventional door latches also have two or more lock states, such as unlocked, locked, child locked, and dead locked states. Inputs to the latch for controlling the lock states of the latch can be mechanical, electrical, or parallel mechanical and electrical inputs. For example, by the turn of a user's key, a cylinder lock can mechanically move the restraint mechanism, thereby unlocking the latch. As another example, cable or rod elements connecting a door handle to the latch release mechanism can be controlled by one or more electrical power actuators. These actuators, sometimes called "power locks" can use electrical motors or solenoids as the force generator to change between locked and unlocked states.

A number of problems exist, however, in the conventional door latches described above. For example, conventional restraint mechanisms in such latches are typically quite complex, with numerous parts often having relatively complicated movements. Such latches are thus more expensive to manufacture, maintain, and repair. This problem is compounded in latches having multiple lock states as mentioned above. These latches often require separate sets of elements corresponding to and controlling each lock state of the latch. Related to this problem are the problems of latch weight and size. The inclusion of more elements and more complex mechanisms within the latch generally undesirably increases the size and weight of the latch. In virtually all vehicle applications, weight and size of any component is a concern. Additionally, increased weight and size of elements and assemblies within the latch necessarily requires more power and greater force to operate the latch. Because power is also at a premium in many applications (especially in vehicular applications), numerous elements and complex assemblies within conventional door latches are an inefficiency that is often wrongly ignored. Not only are larger and more complex latches a power drain, but such latches are typically unnecessarily slow.

Another problem with conventional door latches relates to their operation. Particularly where a latch has multiple lock states, the ability of a user to easily and fully control the latch in its various lock states is quite limited. For example, many latches having a child locked state (i.e., the inside door handle is disabled but the outside door handle is not) require a user to manually set the child locked state by manipulating a lever or other device on the latch. Other latches do not permit the door to enter a dead locked state (i.e., both the inside and outside door handles being disabled). Also, conventional door latches generally do not permit a user to place the door latch in all lock states remotely, such as by a button or buttons on a key fob. These examples are only some of the shortcomings in existing door latch operability.

Still another problem of conventional door latches is related to power locks. The design of existing power lock systems has until now significantly limited the safety of the latch. Latch design limitations exist in conventional latches to ensure, for example, that dead locked latches operated by powered devices or systems will reliably unlock in the event of power interruption or failure. Such limitations have resulted in latch designs which permit less than optimal user operability. Therefore, a reliable design having a failure mode for an electrically powered latch which is electrically actuatable in all locked states remains an elusive goal.

In conventional door latches, yet another problem is caused by the fact that an unauthorized user can often manipulate the restraint mechanism within the latch and/or the connections of the latch to the door locks to unlock the latch. Because existing conventional door latches have at least some type of mechanical linkage from the user-actuated elements (e.g., lock cylinders) to the restraint mechanism in the latch, the ability of an unauthorized user to unlock the latch as just described has been a persistent problem.

In light of the problems and limitations of the prior art described above, a need exists for a latch assembly which has the fewest elements and assemblies possible, is smaller, faster, and lighter than existing latches, consumes less power in operation, is less expensive to manufacture, maintain, and repair, provides a high degree of flexibility in user operation to control the lock states of the latch, has a reliable design in the event of power interruption or failure, and offers improved security against unlocking by an unauthorized user. Each preferred embodiment of the present invention achieves one or more of these results

SUMMARY OF THE INVENTION

In the most highly preferred embodiments of the latch assembly of the present invention, unlocked and locked states of the latch assembly are established by at least two different types of movement of a control element. The control element moves in a first manner through a first path when the latch assembly is in an unlocked state and in a second manner through a second path when the latch assembly is in a locked state. When the control element moves in the first manner, the control element imparts motion either directly or indirectly to a latch element or mechanism (e.g., a ratchet). Such motion moves the latch element or mechanism to move to its unlatched position to unlatch the door. In contrast, when the control element moves in a second manner, the control element does not impart motion (or sufficient motion) to the latch element or mechanism for unlatching the door. Therefore, whether movement or actuation of the control element by a user will unlatch the latch depends upon whether the control element moves in the first or the second manner. The latch assembly of the present invention operates to quickly change the manner of control element motion by preferably extending or retracting one or more elements that guide or limit the motion of the control element. Preferably, these elements are pins which are quickly extended and retracted by one or more actuators.

A highly preferred embodiment of the present invention has two control elements, pins, and actuators. In each control element, pin, and actuator set, the actuator can be extended to extend the pin into a hole in the control element and can also be retracted to retract the pin from the hole. When the actuator and pin are extended and thereby engage the control element, the control element preferably pivots through a first path about a first pivot point. However, when the actuator and pin are retracted and are thereby disengaged from the control element, the control element preferably pivots through a second path about a second pivot point. Movement of the control element through the first path preferably brings the control element into contact with a pawl that is coupled to the latch element or mechanism. This contact causes the latch element or mechanism to release, thereby unlatching the door. In contrast, movement of the control element through the second path preferably does not bring the control element into such contact, or at least into contact sufficient to release the latch element or mechanism. The control element in the second path therefore is in a locked state.

In the most highly preferred embodiments of the present invention, the actuators are electro-mechanical solenoids that perform quick retraction and extension operations to engage and disengage the control elements in their different lock states. The control elements preferably pivot about a hole in each control element that is engaged by the pin in the extended position and about a post, peg, or other element extending from each control element when the pin is not engaged therewith.

In referring herein to "retraction" and "extension" operations of solenoids and to "retracted" and "extended" positions of the solenoids, it should be understood that this is with reference to well known operation of conventional solenoids. Specifically, solenoids typically have one or more elements (such as an armature) which are controllable to extend and retract from the remainder of the solenoid in a well known manner. Terms such as retraction, retracted, extension and extended used herein in connection with a solenoid refers to such conventional solenoid operations.

When the latch assembly of the present invention is used on a vehicle door, a first control element is coupled via a linking member to an inside door handle and a second control element is preferably coupled to an outside door handle. When the pin corresponding to each control element is extended to engage the first and second control elements, respectively, actuation of the control elements by either handle causes the actuated control element to directly or indirectly move a ratchet to unlatch the door. This is the unlocked state of the latch assembly. When the pin corresponding to each control element is retracted to disengage the first and second control elements, actuation of the control elements by either handle does not move the ratchet or does so insufficiently to unlatch the door. This is the dead locked state of the latch assembly. When the pin corresponding to the first control element is extended to engage the first control element and when the pin corresponding to the second control element is retracted to disengage the second control element, actuation of the inside door handle will directly or indirectly move a ratchet to unlatch the door, but actuation of the outside door handle will not do so. This is the locked state of the latch assembly. When the pin corresponding to the first control element is retracted to disengage the first control element and the pin corresponding to the second control element is extended to engage the second control element, actuation of the outside door handle will move the pawl and unlatch the door, but actuation of the inside door handle will not do so. This is the child locked state of the latch assembly. Of course, in other embodiments of the present invention, one, three, or even more control element, pin, and actuator sets can be used as desired.

Latch assembly operations for placing the control elements in their locked and unlocked states are therefore quickly performed via actuators, and most preferably, by electro-magnetic solenoids. Also, the relatively small number of elements (e.g., an actuator, pin, control element, and, if desired, a pawl as described in more detail below) employed to place the latch assembly in its various lock states is a significant advantage over prior art latches. The latch assembly of the present invention is therefore lighter, smaller, can be operated using less power, and can be manufactured, maintained, and repaired at less expense.

In addition, the use of electrical actuators such as electromagnetic solenoids to place the control elements in their various states permits greater flexibility for users in controlling the various latch assembly lock states.

The latch assembly of the present invention also preferably has a control circuit for controlling the actuators. Most preferably, the control circuit is electrical and uses a sensing device to detect changes in the primary power supply (e.g., power loss, power interruption, etc.) supplying power to the latch assembly and to the actuators. At least as a safety feature, certain changes detected in the power supply preferably cause the actuators to automatically engage the pins with the control elements and to thereby unlock the latch assembly.

Because the mechanism for placing the latch assembly in its various lock states is preferably actuated electronically rather than by conventional mechanical means, the latch assembly is also more secure against unauthorized operation. More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
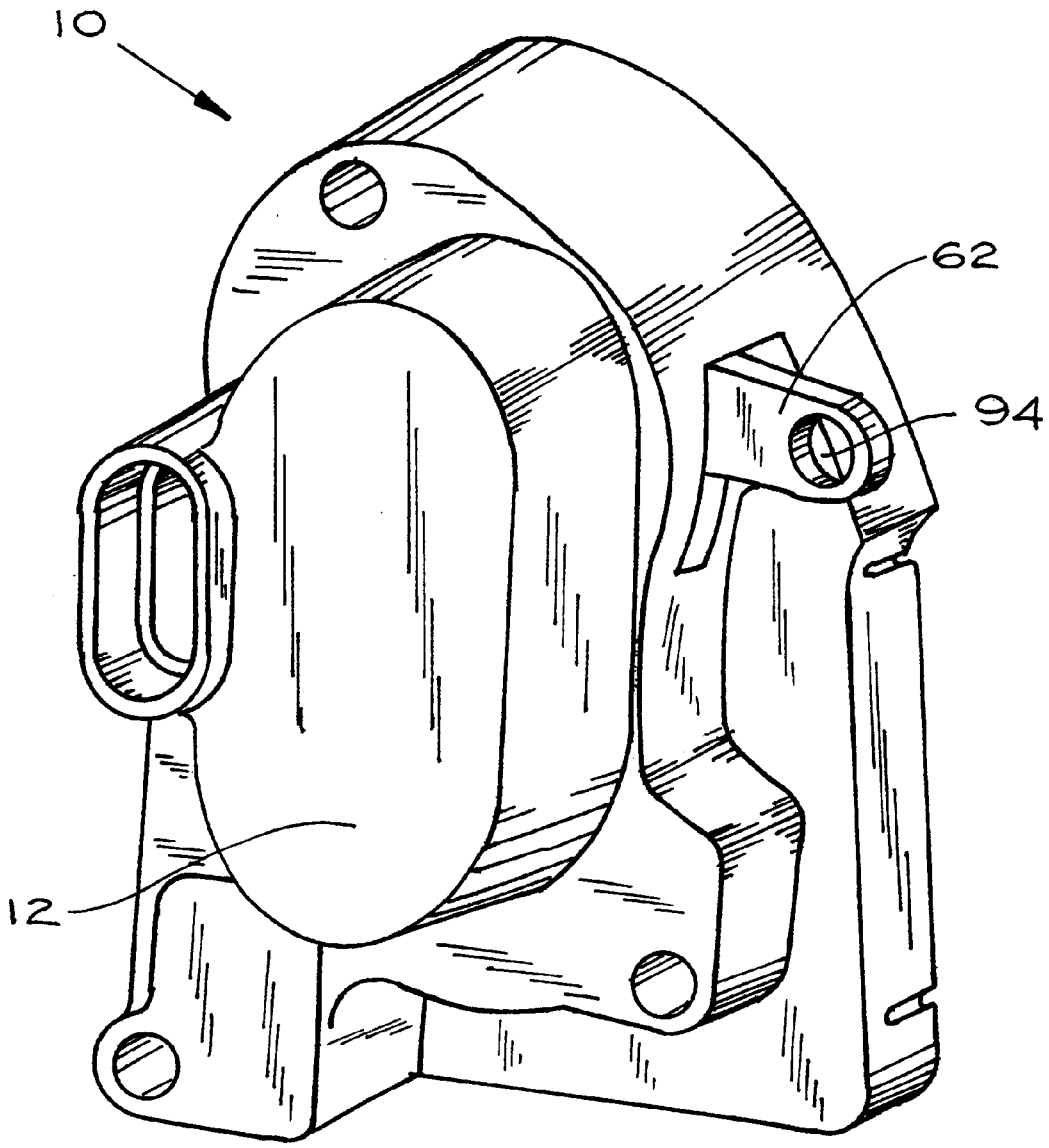
FIG. 1 is a front perspective view, looking down, of a latch mechanism according to a preferred embodiment of the present invention.
Figure 2:
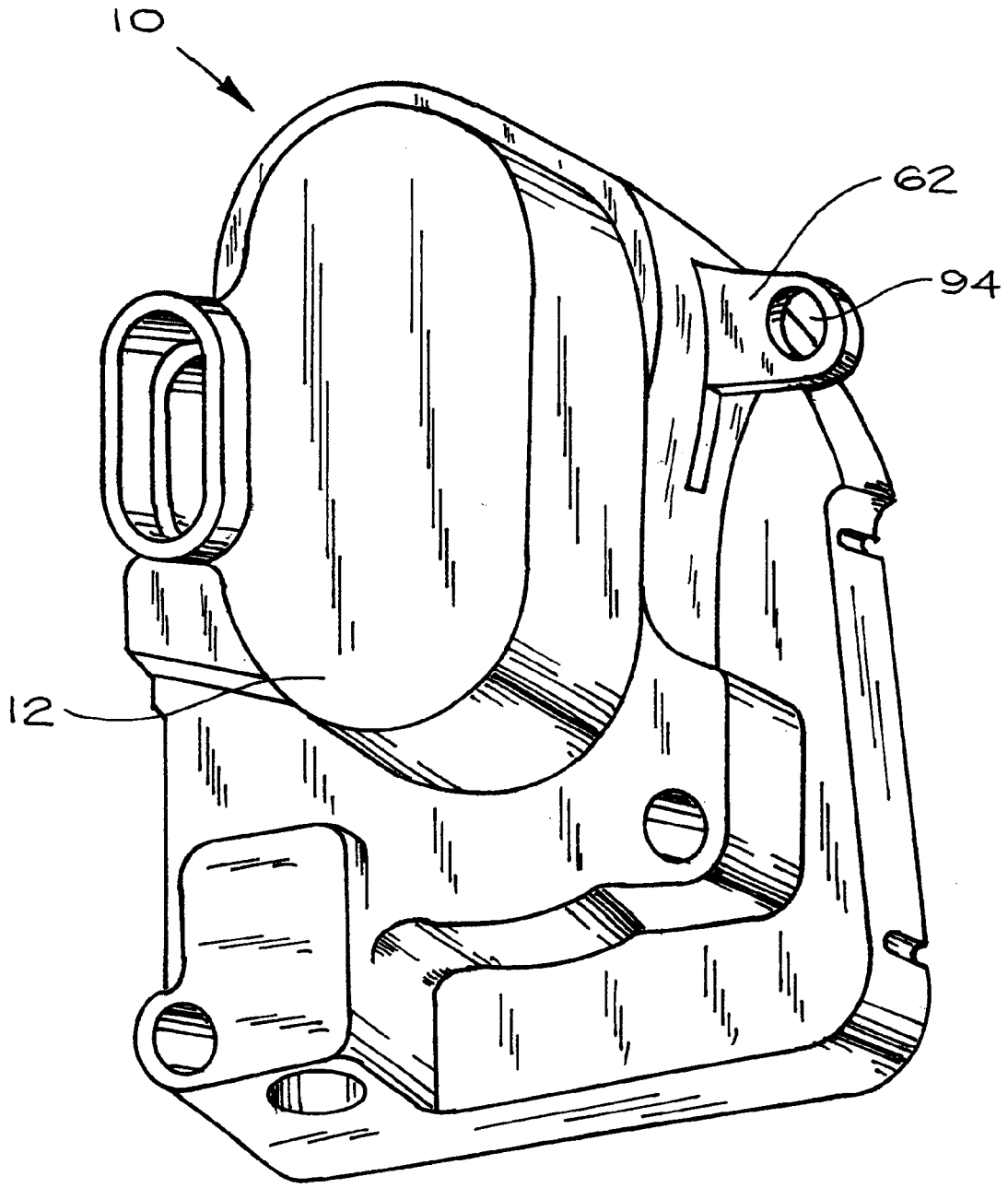
FIG. 2 is a front perspective view, looking up, of the latch mechanism shown in FIG. 1.
Figure 3:
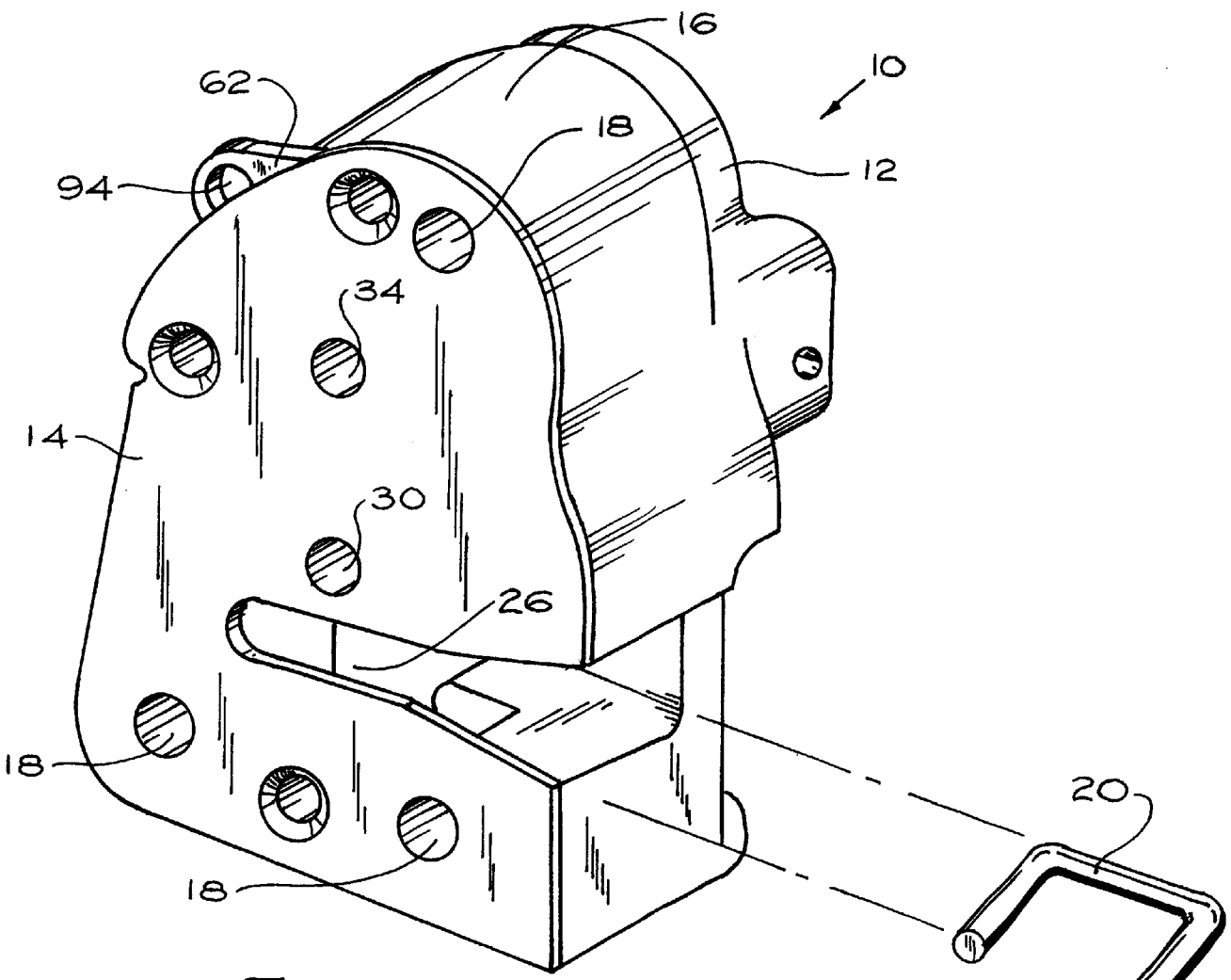
FIG. 3 is a rear perspective view, looking down, of the latch mechanism shown in FIGS. 1 and 2.

While the latch assembly 10 of the present invention is useful in a variety of applications, it is particularly useful in vehicle applications such as for automotive and truck doors. In such applications, the latch assembly 10 preferably has a front cover 12, a rear mounting plate 14 and a housing 16 which collectively enclose the internal elements and mechanisms of the latch assembly 10. A highly preferred embodiment of the latch assembly 10 is shown in FIGS. 1–3. It should be noted that although the following description is with reference to the latch assembly 10 used in vehicle door applications (where application of the latch assembly 10 can be employed with excellent results), the latch assembly 10 can instead be used in many other applications. In fact, the present invention can be used in any application in which it is desirable to releasably secure one body to another. Such applications can be non-automotive and even in applications not involving doors.

The terms of orientation and direction are used herein for ease of description only and do not indicate or imply any required limitation of the present invention. For example, terms such as front, rear, left, right, clockwise, counterclockwise, upper, lower, first, and second as used herein do not indicate or imply that the elements or operations thus described must be oriented or directed in a particular way in the practice of the present invention. One having ordinary skill in the art will recognize that opposite or different orientations and directions are generally possible without departing from the spirit and scope of the present invention. Also, it should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, mating, etc.), elements which can act upon one another (e.g., via camming, pushing, or other interaction) and one element imparting motion directly or through one or more other elements to another element.

Where the latch assembly 10 secures a vehicle door to a door frame or vehicle body, the latch assembly 10 is preferably mounted in a conventional manner to the vehicle door. For example, the rear mounting plate 14 can be provided with fastener holes 18 through which threaded or other conventional fasteners (not shown) are passed and secured to the door. The latch assembly 10 can be secured to the door or to the vehicle body in a number of manners, such as by welding, screwing, bolting, riveting, and the like, all of which are well known to those skilled in the art. Further discussion of securement methods and elements is therefore not provided herein.

Similar to conventional latch assemblies, the latch assembly 10 is designed to releasably capture a striker 20 (see FIG. 3) mounted on the vehicle body (or on the door if the latch assembly 10 is instead mounted on the vehicle body). For this purpose, the latch assembly 10 preferably has a ratchet or fork bolt 22 (see FIGS. 4, 5, 13, and 14) rotatably mounted therein for releasably capturing the striker 20. The ratchet 22, the rear mounting plate 14, and the housing 16 each have a groove 24, 26, 27, respectively, for receiving and capturing the striker 20 to latch the door shut. Specifically, the ratchet 22 is rotatable between a fully open position in which the grooves 24, 26, 27 align with one another to receive the striker 20, and a range of closed positions in which the ratchet 22 is rotated to reposition the groove 24 of the ratchet 22 out of alignment with the grooves 26, 27 of the rear mounting plate 14 and the housing 16 (thereby capturing the striker 20 within the grooves 24, 26, 27). It should be noted that a number of different striker and ratchet designs exist which operate in well known manners to releasably secure a striker (or like element) to a ratchet (or like element). The preferred embodiments of the present invention are useful with these other conventional striker and ratchet designs as well. Such other striker and ratchet designs fall within the spirit and scope of the present invention.

Figure 4:
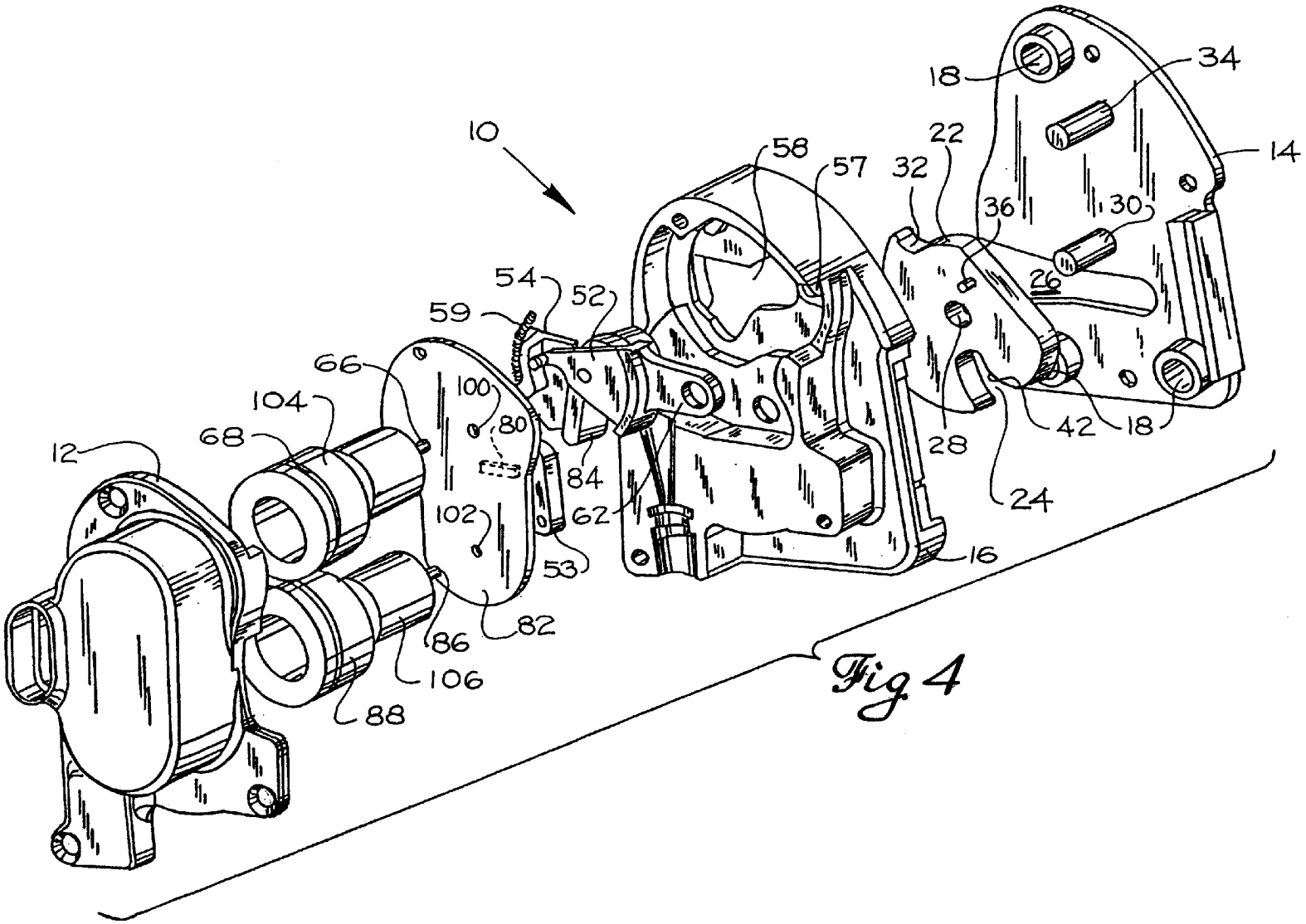
FIG. 4 is an exploded view of the latch mechanism shown in FIGS. 1–3, viewed from the front.
Figure 5:
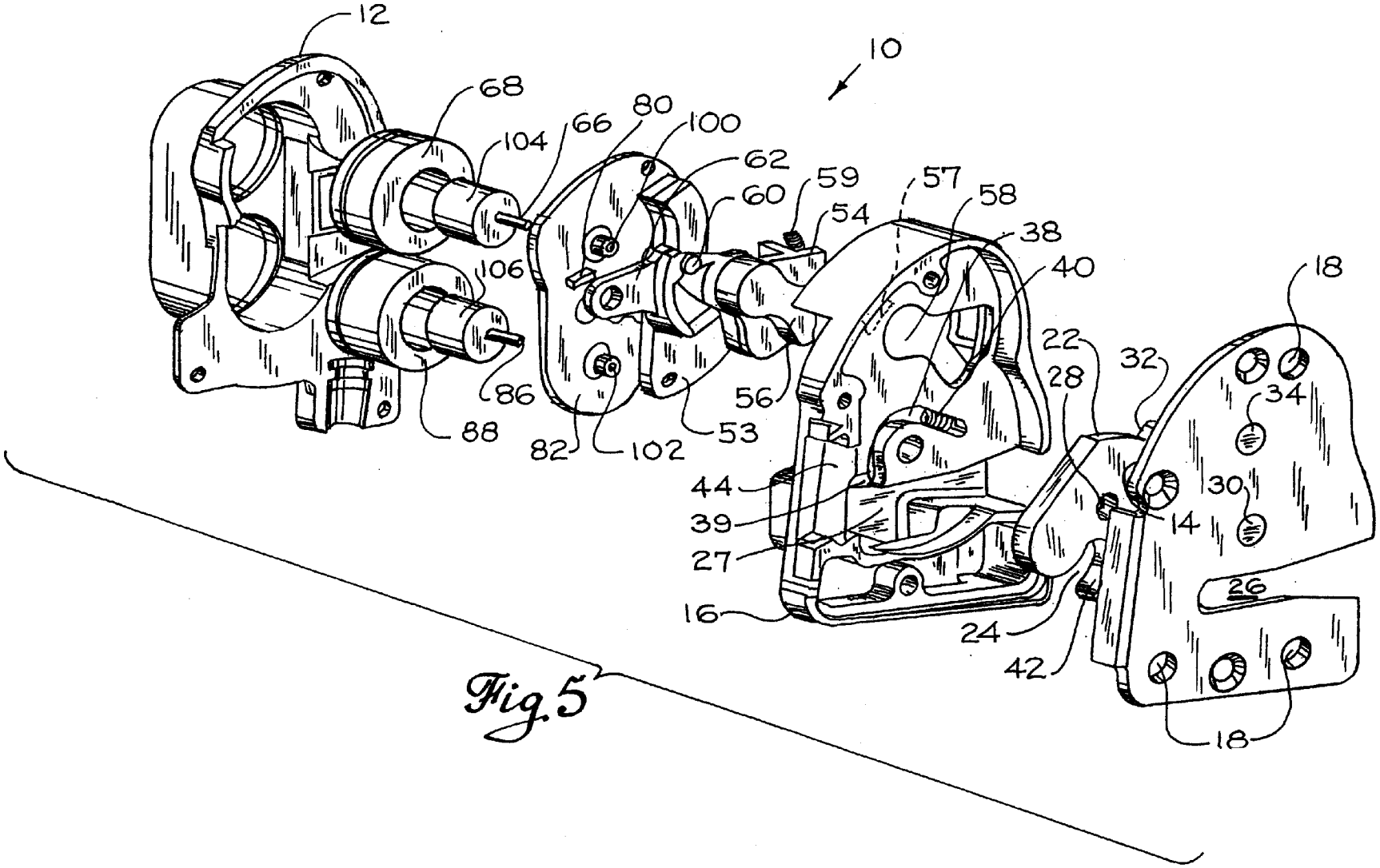
FIG. 5 is an exploded view of the latch mechanism shown in FIGS. 1–4, viewed from the rear.

With particular reference to FIGS. 4 and 5, the operation of the ratchet 22 in capturing and securing the striker 20 within the latch assembly 10 will now be further described. As indicated above, the use of a ratchet in a latch mechanism is well-known to those skilled in the art. In the latch assembly 10 of the present invention, the ratchet 22 is preferably provided with an aperture 28 for mounting the ratchet 22 to the rear mounting plate 14. The aperture 28 is sized and shaped to rotatably receive a lower pivot post 30 extending from the rear mounting plate 14. The lower pivot post 30 is preferably fastened to the rear mounting plate 14 in a conventional manner, such as by a riveting, screwing, bolting, or other conventional fastening techniques. The lower pivot post 30 can instead be made integral with the rear mounting plate 14. Sufficient clearance is provided between the lower pivot post 30 and the aperture 28 of the ratchet 22 so that the ratchet 22 can rotate substantially freely about the lower pivot post 30.

In order to control the movement of the ratchet 22 within the latch assembly 10, rotation of the ratchet 22 is preferably limited at two locations as follows. First, the ratchet 22 is prevented from rotation beyond the point where the grooves 24, 26, 27 of the ratchet 22, the rear mounting plate 14, and the housing 16 are aligned for receiving the striker 20 as described above. This limitation exists due primarily to the manner in which the striker 20 moves through the grooves 24, 26, 27 as it enters the latch assembly 10. When the striker 20 has rotated the ratchet 22 to the position shown in FIGS. 4 and 5, the striker 20 is preferably stopped by an elastomeric element 44 (described in more detail below) located between the rear mounting plate 14 and the housing 16. Because the striker 20 is trapped between the grooves 24, 26, 27 of the ratchet 22, the rear mounting plate 14, and the housing 16 in this position, the ratchet 22 cannot rotate further in the counterclockwise direction as viewed in FIG. 4. In addition, the ratchet 22 is preferably provided with a stop pin 36 which fits into a stop pin groove 38 in the housing 16 (see FIG. 5). As best viewed in FIG. 5, a ratchet spring 40 is also preferably fitted within the stop pin groove 38 and exerts a reactive force against the stop pin 36 when compressed by rotation of the ratchet 22 in the counterclockwise direction as viewed in FIG. 4. Therefore, when the ratchet 22 is rotated in the counterclockwise direction as viewed in FIG. 4, the ratchet spring 40 and the termination of the stop pin groove 38 in the housing 16 prevents further rotation of the ratchet 22 in the same direction.

To limit movement of the ratchet 22 in the clockwise direction as viewed in FIG. 4, the stop pin groove 38 has a terminal section 39 (see FIG. 5) within which the stop pin 36 is stopped when the ratchet 22 is rotated under force of the ratchet spring 40 in the clockwise direction as viewed in FIG. 4. As such, the ratchet 22 is effectively limited in movement in one direction by the stop pin 36 against the ratchet spring 40 and by the striker 20 stopped by the elastomeric element 44 and trapped within the grooves 24, 26, 27, and limited in movement in the opposite direction by the stop pin 36 within the terminal section 39 of the stop pin groove 38.

It should be noted that the ratchet 22 is preferably biased into its unlatched position (clockwise as viewed in FIG. 4) by the ratchet spring 40. The latch assembly 10 therefore returns to an unlatched state unless movement of the ratchet 22 is interfered with as will be discussed in more detail below. When the striker 20 is inserted into the grooves 24, 26, 27 of the ratchet 22, the rear mounting plate 14, and the housing 16 in this unlatched position, the striker 20 presses against the lower wall 42 of the groove 24 in the ratchet 22 (see FIG. 14) and thereby causes the ratchet 22 to rotate about the lower pivot post 30 against the compressive force of the ratchet spring 40 in the stop pin groove 38. Further insertion of the striker 20 rotates the ratchet 22 until the striker 20 contacts and is stopped by the elastomeric element 44 (described below) and/or until the reactive force of the ratchet spring 40 stops the ratchet 22.

Due to the high impact forces commonly experienced by the latch assembly 10 as the striker 20 enters and is stopped by the latch assembly 10, it is desirable to cushion the impact of the striker 20 upon the latch assembly 10 as the striker 20 is stopped. To this end, one well-known element preferably used in the present invention is an elastomeric element 44 located behind the termination of the groove 26 in the rear mounting plate 14. The elastomeric element 44, secured in a conventional manner to the rear mounting plate 14 and/or to the housing 16, is an impact absorbing article preferably made of an elastomeric material such as rubber, urethane, plastic, or other resilient material having a low deformation memory.

The elastomeric element 44 not only performs the function of absorbing potentially damaging forces experienced by the latch assembly 10 during striker capture, but also acts to reduce the operational noise emitted by the latch assembly 10. One having ordinary skill in the art will appreciate that a number of other conventional damper and impact absorbing elements and devices can be used in the latch assembly 10 of the present invention to protect the latch assembly 10 from high impact forces and to reduce latch noise. These other damper and impact absorbing elements fall within the spirit and scope of the present invention.

The ratchet 22, the rear mounting plate 14, the elastomeric element 44, and their operational relationship with respect to the striker 20 as described above is generally conventional and well known to those skilled in the art. In operation, prior art latch mechanisms employ one or more elements which interact or interfere with the ratchet 22 at particular positions in its rotation to prevent rotation of the ratchet 22 to its unlatched position once the striker 20 is inserted sufficiently within the latch assembly 10. For example, such elements can be brought into contact with a stop surface 32 of the ratchet 22 when the ratchet 22 is in its latched position (i.e., rotated to a counterclockwise position as viewed in FIG. 4). When it is desired to release the striker 20 in an unlatching procedure, the elements are removed from interference with the ratchet 22 and the ratchet 22 is returned to its unlatched position (e.g., by the ratchet spring 40). As described above in the Background of the Invention, the prior art mechanisms and elements used to selectively insert and remove such elements from the ratchet 22 are virtually always complex, expensive to manufacture, inefficient, and relatively slow.

In one preferred embodiment of the present invention, the latch assembly 10 has a pawl 54 as best seen in FIGS. 4–12. The pawl 54 is rotatably mounted upon an upper pivot post 34 extending from the rear mounting plate 14. The upper pivot post 34, like the lower pivot post 30, is preferably attached to the rear mounting plate 14 by fastening, riveting, screwing, bolting, or other conventional fastening methods. The upper pivot post 34 can instead be made integral with the rear mounting plate 14, if desired.

Figure 13:
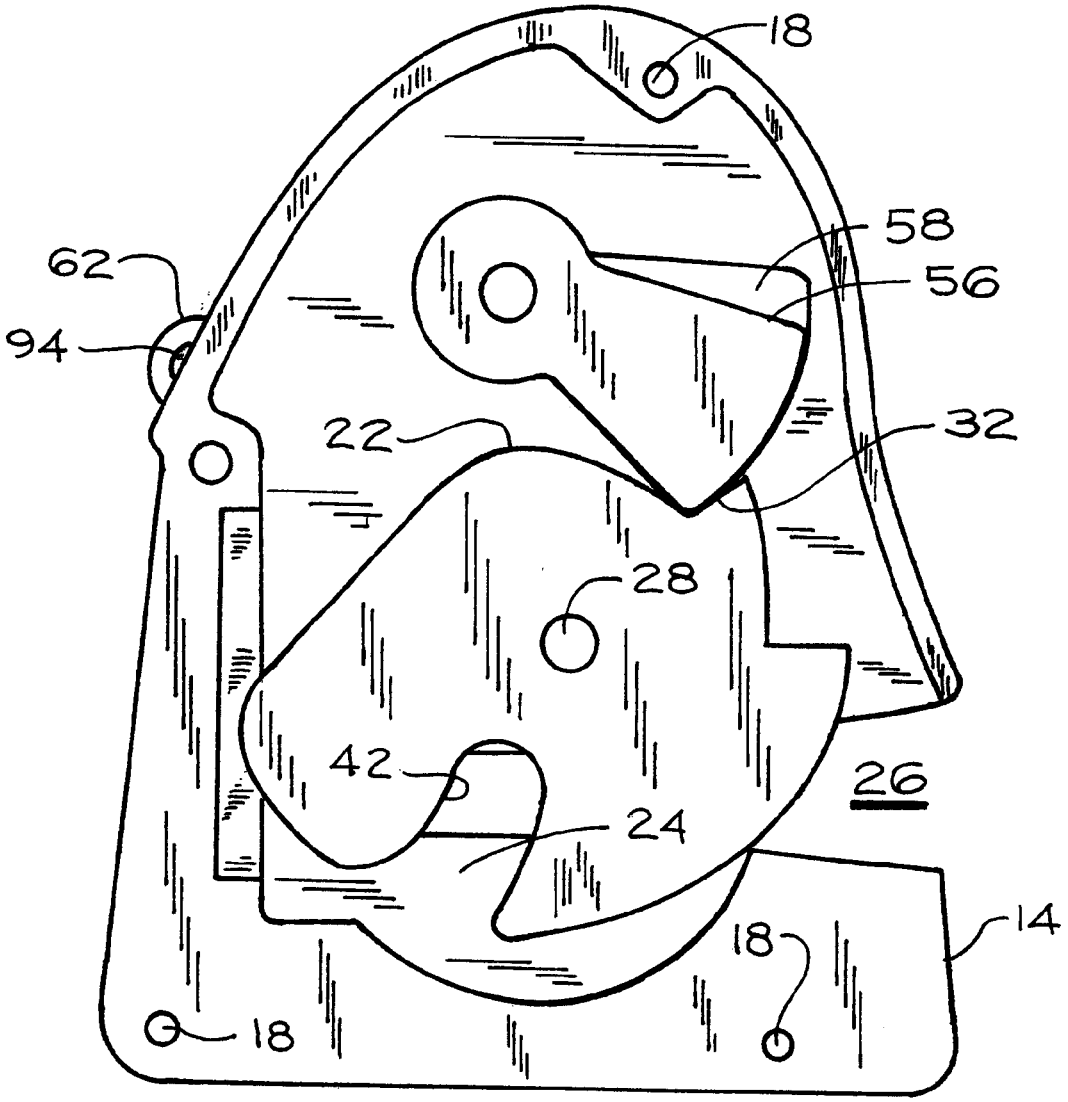
FIG. 13 is a rear elevational view of the latch mechanism shown in FIGS. 1–12, with the rear mounting plate removed and with the pawl engaged with the ratchet.
Figure 14:
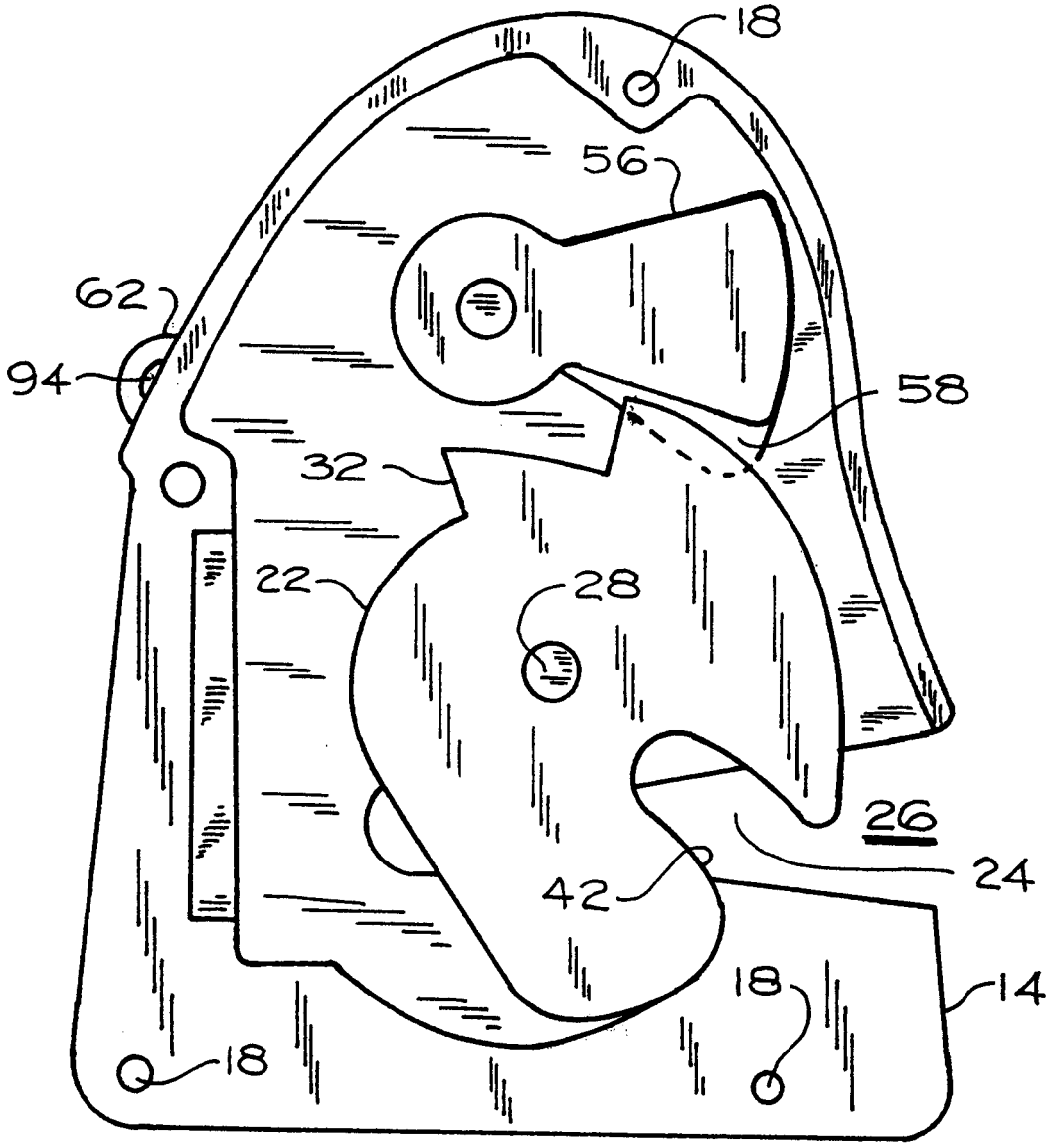
FIG. 14 is a rear elevational view of the latch mechanism shown in FIGS. 1–13, with the rear mounting plate removed and with the pawl disengaged from the ratchet.

The pawl 54 preferably includes a cam 56 (see FIGS. 5, 13, and 14). The body of the pawl 54 is preferably located on a side of the housing 16 opposite the ratchet 22. However, the cam 56 of the pawl 54 preferably extends through an aperture 58 within the housing 16 to place the cam 56 in selective engagement with the ratchet 22. Specifically, the pawl's fit within the aperture 58 of the housing 16 is loose enough to permit an amount of movement of the cam 56 relative to the ratchet 22. It should be noted that although the housing shape illustrated in the figures is preferred in the present invention, other housing shapes can be used (e.g., having a different aperture type for accepting different pawls 54, cams 56, and different pawl and cam motions, different housing interior shapes and sizes for accepting different control elements and control element motions, etc.). As best shown in FIGS. 13 and 14, the pawl 54 and the cam 56 can preferably be placed in one position (FIG. 13) in which the cam 56 engages with the stop surface 32 of the ratchet 22 when the ratchet 22 is in its latched position and in another position (FIG. 14) in which the cam 56 is retracted from and does not interfere with rotation of the ratchet 22. In the retracted pawl position, the ratchet spring 40 causes the ratchet 22 to automatically rotate to its unlatched position shown in FIG. 14 as described above.

The pawl 54 is preferably biased into its ratchet interfering position by a pawl spring 59. Referring to FIGS. 7–12, it can be seen that the pawl spring 59 is preferably a compression spring contained between walls of the pawl 54 and the housing 16. The pawl spring 59 biases the pawl 54 in a counterclockwise direction as viewed in FIGS. 7–12, thereby pressing the cam 56 toward the ratchet 22 on the opposite side of the housing 16. It will be appreciated that although the pawl spring 59 is shown secured between walls of the pawl 54 and the housing 16, such an arrangement and position is not required to perform the function of biasing the pawl 54 in the counterclockwise direction as viewed in FIGS. 7–12. Indeed, the pawl spring 59 can instead be rigidly attached at one end to a part of the pawl 54, can be rigidly attached to an inside wall of the housing 16, can be contained within walls solely in the pawl 54 or solely in the housing 16 (still permitting, of course, an end of the pawl spring 59 to exert force against the pawl 54 and another end to exert force against the housing 16), and the like. Any such configuration in which the pawl spring 59 is positioned to exert a force against the pawl 54 in a counterclockwise direction as viewed in FIGS. 7–12 can instead be used in the present invention. Such alternative configurations are well known to those skilled in the art and are therefore encompassed within the spirit and scope of the present invention.

The preferred embodiment of the present invention just described also has at least one control element 52. By moving the pawl 54 (e.g., rotating the pawl 54 in the preferred embodiment), the latch assembly 10 can be placed in its unlatched state or can be secured in its latched state by virtue of the pawl's relationship with the ratchet 22. With proper positioning and control of the control element 52, movement of the control element 52 to press and/or ride against the pawl 54 therefore moves the pawl 54 to release the ratchet 22 and thereby to release the striker 20. With different positioning and control of the control element 52, movement of the control element 52 does not impart movement to the pawl 54 and therefore does not release the ratchet 22 to release the striker 20. As will now be described, the control element 52 of the present invention can be positioned and controlled in either manner to define an unlatched state of the latch assembly 10 and a latched state of the latch assembly 10.

Turning to FIGS. 7–12, a highly preferred embodiment of the present invention has a right and a left control element 52, 53, respectively. Once again, the terms "right" and "left" are used only for ease of description, and do not imply that these elements necessarily be in a right and left position with respect to each other or to other elements in the latch assembly 10. Other orientations are possible and fall within the scope of the present invention. The control elements 52, 53 preferably act as levers in the latch assembly 10, and are externally actuatable by a user. However, and as described below in greater detail, the control elements 52, 53 need not necessarily pivot (an inherent part of a lever's operation), but can instead translate and/or translate and rotate in alternate embodiments of the present invention. Therefore, the term "lever" as used herein does not necessarily require that the control elements 52, 53 pivot or exclusively pivot.

Figure 9:
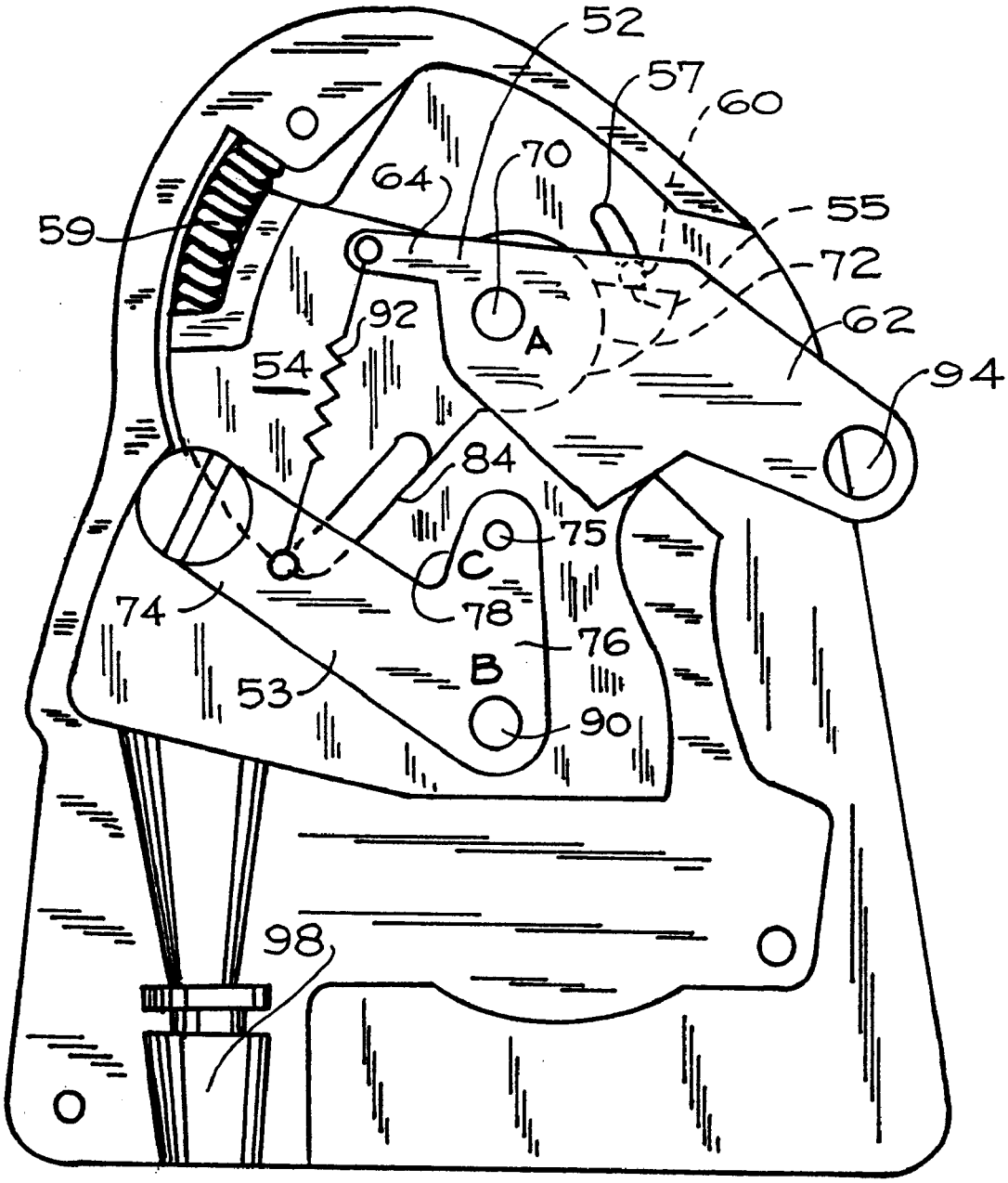
FIG. 9 is a front elevational view of the latch mechanism shown in FIG. 7, with the latch mechanism unlocked and with the right control element actuated.
Figure 10:
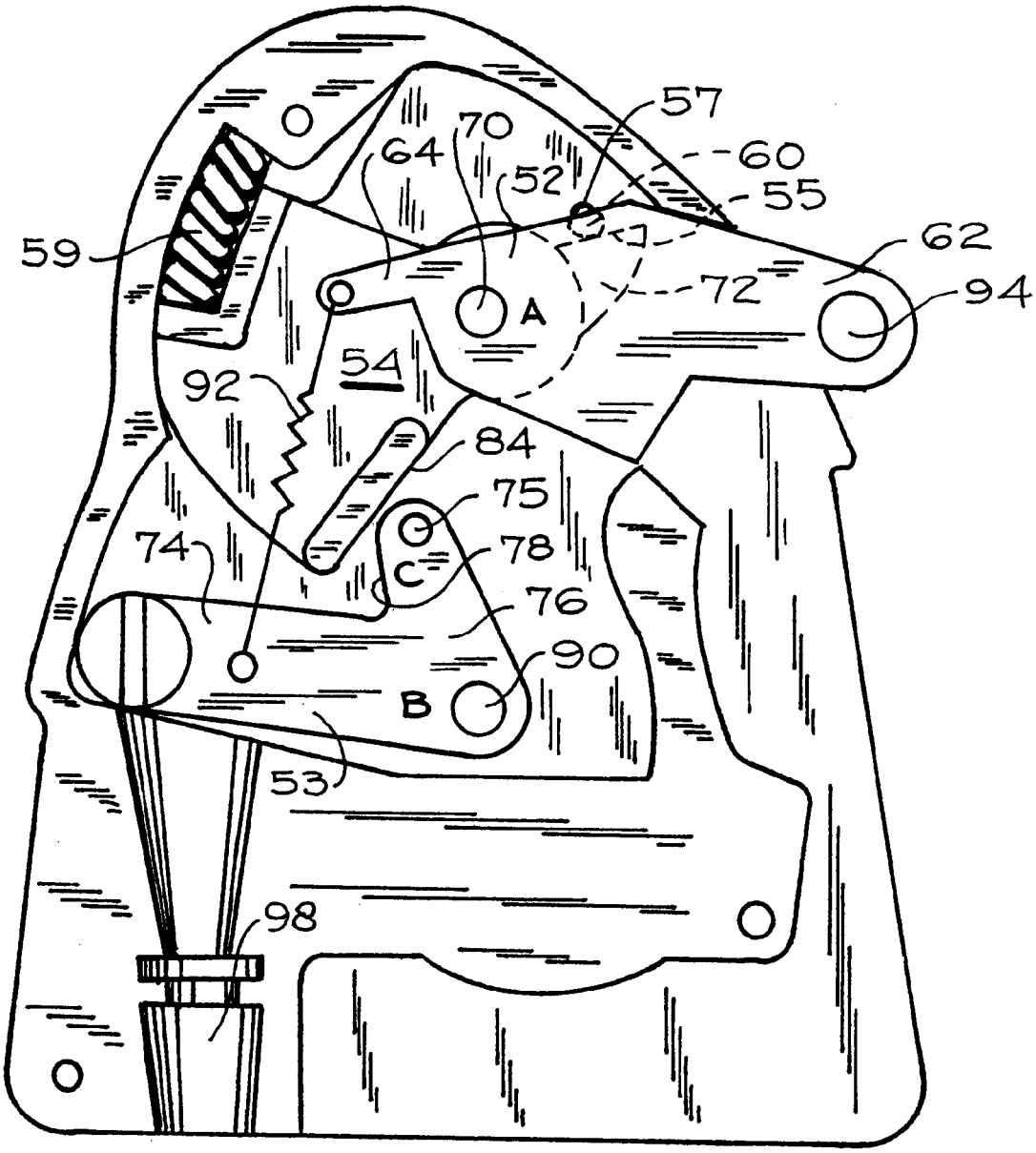
FIG. 10 is a front elevational view of the latch mechanism shown in FIG. 7, with the latch mechanism unlocked and with the left control element actuated.
Figure 11:
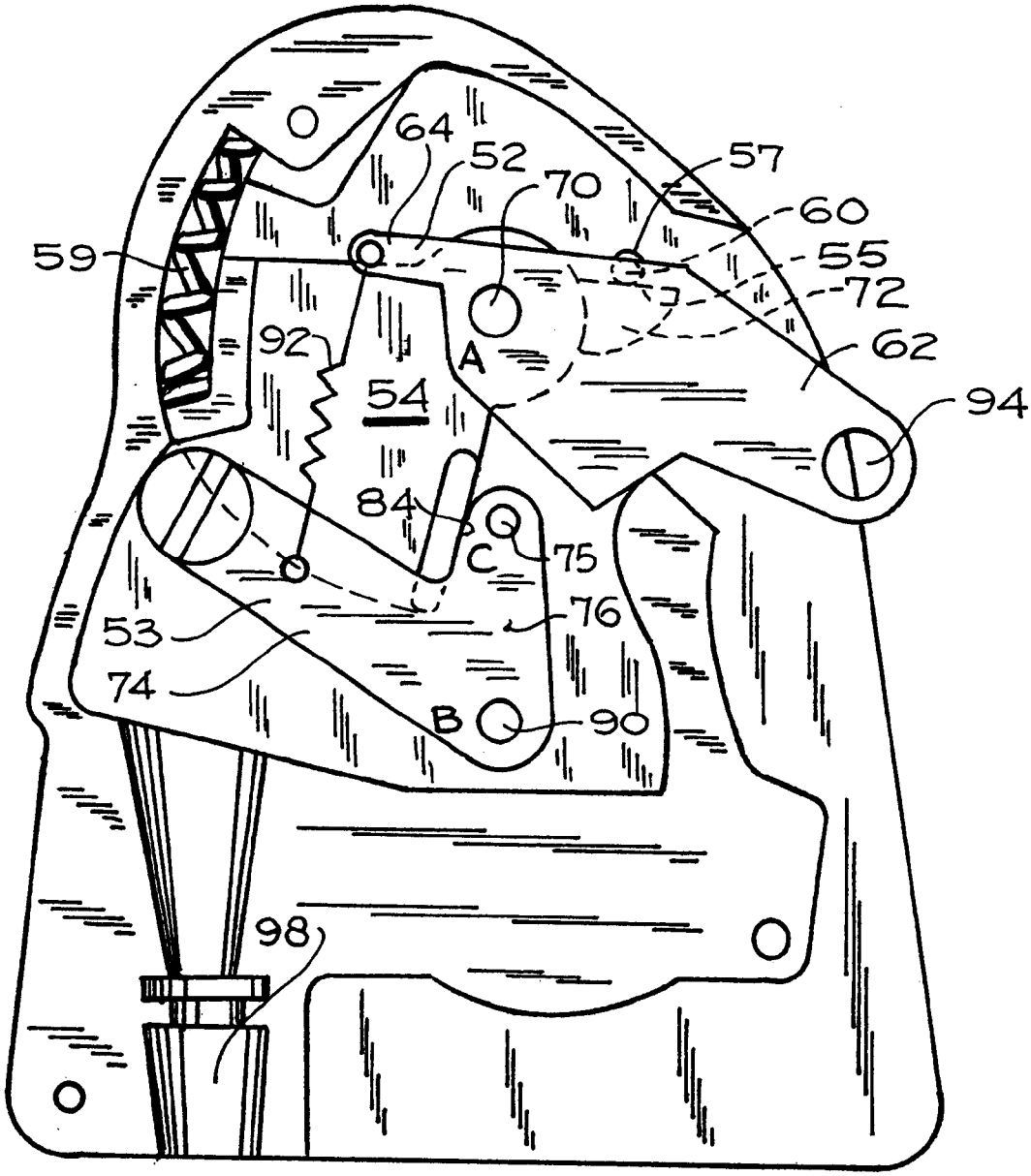
FIG. 11 is a front elevational view of the latch mechanism shown in FIG. 7, with the latch mechanism locked and with the right control element actuated.

Referring to FIGS. 4 and 7–12, it can be seen that the right control element 52 preferably has a first pivot point A (see FIGS. 8–12), an abutment post 60, a linkage end 62, and a lever end 64 opposite the linkage end 62. The abutment post 60 is preferably in abutting relationship with a ledge 72 of the pawl 54 at a bearing surface 55 of the pawl 54. Therefore, as shown in FIG. 11, when an actuating force is exerted (downwardly) against the linkage end 62 of the right control element 52, the right control element 52 rotates in a clockwise direction about the abutment post 60 which acts as a fulcrum for the right control element 52 and as a bearing surface against the bearing surface 55 of the pawl 54. However, if the right control element 52 is also engaged for rotation about pivot point A, the same actuation force against the linkage end 62 of the right control element 52 rotates the right control element 52 and the pawl 54 together about pivot point A (rather than rotating the right control element 52 about the abutment post 60). In this latter case, the abutment post 60 acts as a bearing surface against the bearing surface 55 of the pawl 54 as the pawl bearing surface 55 is pushed downward. It can thus be seen that by engaging and disengaging the right control element 52 for pivotal movement about pivot point A, actuation of the right control element 52 will either rotate the pawl 54 or not rotate the pawl 54, respectively. FIG. 9 thus defines an unlocked state of the latch assembly 10 (with the right control element 52 engaged for rotation about pivot point A) because rotation of the pawl 54 will cause release of the ratchet 22 and the striker 20 (see FIG. 14). Also, FIG. 11 thus defines a locked state of the latch assembly 10 (with the right control element 52 disengaged from rotation about pivot point A) because the pawl 54 does not rotate with the right control element 52 to release the ratchet 22 and the striker 20 (see FIG. 13). To better control the movement of the right control element 52 either in its locked state or in its unlocked state, highly preferred embodiments of the present invention have a groove 57 in the housing 16 within which the abutment post 60 of the right control element 52 is received (see FIGS. 4 and 5). When the right control element 52 pivots about the abutment post 60, the abutment post 60 rotates in place at the top of the groove 57, held there by the bearing surface 55 of the pawl 54. When the right control element 52 is instead engaged for pivotal movement about pivot point A, the abutment post 60 travels down the groove 57 while it pushes the pawl 54 in a clockwise direction.

With the above relationship between the right control element 52 and the pawl 54 in mind, switching between the locked and unlocked states of the right control element 52 is therefore ultimately dependent upon disengagement and engagement operations, respectively, of the right control element 52 for rotation about pivot point A. Such operations can be performed in a number of ways. The most highly preferred method in the present invention is via a pin 66 (see FIG. 5) selectively retracted and extended by a high-speed actuator 68. When the actuator 68 is placed in its extended position, the pin 66 is preferably inserted into an aperture 70 (see FIGS. 7–12) in the right control element 52 at pivot point A, thereby controlling the right control element 52 to rotate about pivot point A when actuated by a user. When the actuator 68 is placed in its retracted position, the pin 66 is preferably retracted from the aperture 70, thereby permitting the right control element 52 to pivot about the abutment post 60. The arrangement just described therefore reduces the time for placing the control element 52 in its locked and unlocked positions to the time required for disengaging and engaging the right control element 52 with the pin 66. This time can be quite short depending upon the type of actuator 68 used. In contrast to prior art devices which require engagement elements which operate parallel to the plane of motion of the control elements, the engagement elements of the present invention operate perpendicular to the plane of motion of the control elements. This arrangement also reduces the forces required to move the engagement elements. Accordingly, an actuator with a relatively short stroke can be used to place the control elements 52, 53 in their locked and unlocked states, which generally results in a faster motion. In fact, in highly preferred embodiments of the present invention, actuator extension and retraction operations can be completed in under 10 milliseconds. Prior art devices require significantly more time to perform comparable latch assembly operations. Of course, one or more manual actuators can instead be used in the present invention to manually insert the pin 66 or move any other engagement element into engagement with the control elements 52, 53. The actuators described herein and the other major components of the latch assembly 10 are preferably constructed as modules, enabling ready replacement or substitution.

Figure 12:
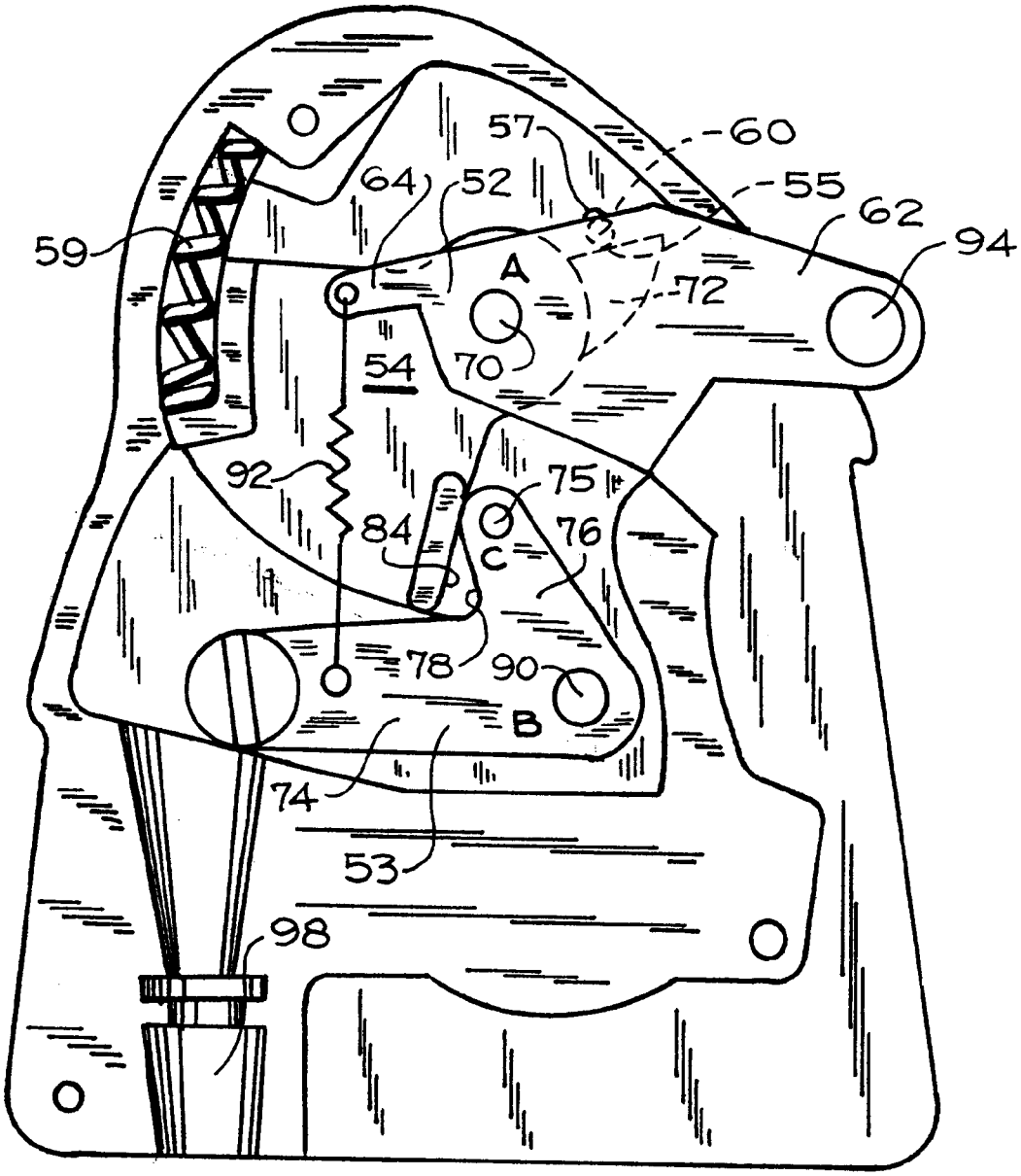
FIG. 12 is a front elevational view of the latch mechanism shown in FIG. 7, with the latch mechanism locked and with the left control element actuated.

Following along very similar structural and operational principles as the right control element 52, the left control element 53 also has a first pivot point B, a linkage end 74, a lever end 76 opposite the linkage end 74, and a rotation peg 75 defining a second pivot point C. Although the left control element 53 is also preferably a lever, in the preferred embodiment of the present invention shown in the figures, the left control element 53 is L-shaped and preferably has a cam surface 78 located adjacent the pawl 54. Therefore, and as shown in FIG. 12, when an actuating force is exerted (downwardly) against the linkage end 74 of the left control element 53, the left control element 53 preferably rotates in a counterclockwise direction about the rotation peg 75. Accordingly, the left control element 53 does not act upon the pawl 54 during rotation of the left control element 53 about the rotation peg 75 as shown in FIG. 12. To prevent unwanted translational movement of the rotation peg 75 during the counterclockwise rotation of the left control element 53, the rotation peg 75 preferably rests in a groove 80 of the cover plate 82 (see FIGS. 4 and 5). Of course, other well known elements can be used to prevent this translation, such as a ledge or rib extending from the rear surface of the cover plate 82.

However, if the left control element 53 is engaged for rotation about pivot point B, the same actuation force against the linkage end 74 of the left control element 53 rotates the left control element 53 to press the cam surface 78 of the left control element 53 into a cam surface 84 of the pawl 54, thereby rotating the pawl 54 about the upper pivot post 34. It can thus be seen that by engaging and disengaging the left control element 53 for pivotal movement about pivot point B, actuation of the left control element 53 will either rotate the pawl 54 or not rotate the pawl 54, respectively. FIG. 10 thus defines an unlocked state of the latch assembly 10 (with the left control element 53 engaged for rotation about pivot point B), because rotation of the pawl 54 will cause release of the ratchet 22 and the striker 20. Also, FIG. 12 thus defines a locked state of the latch assembly 10 (with the left control element 53 disengaged from rotation about pivot point B) because the pawl 54 does not rotate under camming force exerted by the left control element 53 to release the ratchet 22 and the striker 20.

As with the right control element 52, switching between the locked and unlocked states of the left control element 53 is therefore ultimately dependent upon disengagement and engagement operations, respectively, of the left control element 53 for rotation about pivot point B. Also as with the right control element 52, the preferred method of performing such operations in the present invention is via a pin 86 (see FIG. 5) selectively retracted and extended by a high-speed actuator 88. When the actuator 88 is placed in its extended position, the pin 86 is preferably inserted into an aperture 90 (see FIGS. 7–12) in the left control element 53 at pivot point B, thereby controlling the left control element 53 to rotate about pivot point B when actuated by a user. When the actuator 88 is placed in its retracted position, the pin 86 is retracted from the aperture 90, thereby controlling the left control element 53 to pivot about its rotation peg 75 when actuated by a user. The arrangement just described therefore reduces the time for placing the left control element 53 in its locked and unlocked positions to the time required for disengaging and engaging the left control element 53 with the pin 86. This time can be quite short depending upon the type of actuator 88 used.

For proper positioning of the right and left control elements 52, 53 within the latch assembly 10, the latch assembly 10 preferably has at least one control element spring 92 (see FIGS. 7–12). In the most preferred embodiment of the present invention, one control element spring 92 is connected in a conventional manner between the ends 64, 74 of the right and left control elements 52, 53, respectively. Preferably, the control element spring 92 is connected to each end 64, 74 by being hooked onto posts formed near the ends 64, 74. However, the control element spring 92 can be fastened to the ends 64, 74 in a number of other well known manners (e.g., via a fastener securing the ends of the spring 92 in place upon the ends 64, 74, via welding, glue, epoxy, etc.). The control element spring 92 acts to bias the control elements 52, 53 toward one another and into their unactuated positions shown in FIG. 8.

One having ordinary skill in the art will recognize that the particular control element spring 92 and its location within the latch assembly 10 shown in the figures is only one of a number of different control element spring types and locations serving this biasing function. For example, two or more control element springs can instead be used to bias the control elements 52, 53 into their unactuated positions. In such a case, the control element springs can be attached between the ends 64, 74 and the housing 16. Alternatively, the control element springs can be of a different form than the extension spring shown in the figures. For example, the control element springs can be coil, torsion, or leaf springs arranged in the latch assembly 10 to bias the control elements 52, 53 as described above. Such alternate biasing elements and arrangements fall within the spirit and scope of the present invention.

Prior to describing the actuators 68, 88 and their operation in more detail, the mechanical actuation of the control elements 52, 53 will now be described. Each control element 52, 53 is provided with a linkage end 62, 74 upon which external forces are preferably exerted to actuate the control elements 52, 53. In the case of the right control element 52, the linkage end 62 is preferably an arm of the right control element 52 having an aperture 94 therethrough at its terminal portion. In the case of the left control element 53, the linkage end 74 is preferably a post having an aperture 96 therethrough. When the latch assembly 10 is installed, an external linking element (not shown) is connected via the aperture 94 to the right control element 52 and an external linking element (also not shown) is connected via the aperture 96 to the left control element 53. Because the left control element 53 is preferably located fully within the latch assembly 10, the linking element is passed through a port 98 within the housing 16 and the cover 12 of the latch assembly 10. Of course, the port 98 can take any number of shapes and locations within the housing 16 and/or the cover 12 to permit the external linking element to be connected inside the latch assembly 10 to the left control element 53.

In the highly preferred embodiment of the present invention shown in the figures, the linking element connected in a conventional fashion to the right control element 52 is preferably a bar or member connected and directly actuated by, e.g., a door handle, while the linking element connected to the left control element 53 is preferably a cable which is secured in a conventional fashion to the linkage end 74. The linking element connected to the left control element 53 is preferably passed out of the latch assembly 10 through the port 98. It should be noted that although cables are preferred, other types of linking elements can be used, such as rods, bars, chains, string, rope, etc. In fact, the linking elements can even be made integral to or extensions of the control elements 52, 53 themselves. The particular type of linking element used is dependent at least in part upon the shape, size, and position of opening(s) in the cover 12 and/or the housing 16 to permit the control elements 52, 53 to be connected to the external linking elements. The particular type of linking element used can also depend upon whether attachment of the control elements 52, 53 to the linking elements is accomplished externally of the cover 12 and/or the housing 16 (such as in the case of the right control element 52 shown in the figures) or internally (such as in the case of the left control element).

The latch assembly 10 described above and illustrated in the figures finds particular application for doors having two handles, such as an internal handle and an external handle. In this application, one handle is connected to the right control element 52 and the other handle is connected to the left control element 53 via the linking elements described above. Therefore, actuation of one handle actuates one control element while actuation of the another handle actuates the other control element. The manner of connection of the linking elements to the handles is well known to those skilled in the art and is therefore not described further herein. It should also be noted that the linking elements need not necessarily be attached to door handles. Especially where the latch assembly 10 is used in applications not involving vehicle doors (or indeed, any type of door), the control elements 52, 53 can be actuated either indirectly via linking elements or directly to operate the latch assembly 10. Any number of conventional elements and mechanisms can be linked to the control elements 52, 53 to effect their actuation as desired. As described above, the type of movement of the control elements 52, 53 (when actuated) is dependent upon whether the pins 66, 86 are extended or retracted to engage with the control elements 52, 53. When the pins 66, 86 are extended by the actuators 68, 88 to engage the control elements 52, 53, the control elements 52, 53 preferably pivot about pivot points A and B, respectively, which permits the control elements 52, 53 to exert motive force to the pawl 54. When the pins 66, 86 are retracted by the actuators 68, 88 to disengage from the control elements 52, 53, the control elements 52, 53 preferably pivot instead about abutment post 60 and rotation peg 75, respectively, which prevents the control elements 52, 53 from exerting force upon the pawl 54 sufficient to move (rotate) the pawl 54. Because the speed in which the control elements 52, 53 are placed in their locked and unlocked states is thus dependent upon the speed of the actuators 68, 88 to move the pins 66, 86, it is desirable to use the fastest actuator type economically reasonable for the actuators 68, 88. In the most preferred embodiment of the present invention, the actuators 68, 88 are each a two-position residual magnetic latching electromagnetic solenoid such as those commercially available from and sold by TLX Technologies of Waukesha, Wis. However, other conventional actuator types are possible, including other types of solenoids, conventional hydraulic or vacuum actuators, small motors, and even elements or assemblies which are manually operated to push and retract the pins 66, 86 to place the control elements 52, 53 into their locked and unlocked positions. Though not as preferred as two-position electromagnetic solenoids, these alternative actuators fall within the spirit and scope of the present invention.

The actuators 68, 88 are preferably connected to an electronic control circuit which is controllable by a user for placing the actuators 68, 88 in their engaged and disengaged states, thereby placing the latch assembly 10 in its unlocked and locked states, respectively. Upon command by the user, the electronic control circuit preferably generates electronic pulses to the actuators 68, 88 for controlling their movement. To secure against accidental or unauthorized actuation, a coded signal can be sent to the electronic control circuit. Coding of electronic signals is well known to those skilled in the art and is not therefore discussed further herein. The electronic control circuit can be powered in a conventional manner, such as by a battery, an alternator, a generator, a capacitor, a vehicle electrical system or other conventional power source.

With reference to the preferred embodiment of the present invention, the actuators 68, 88 are electromagnetic solenoids which can retain residual magnetism to hold the actuators 68, 88 in their retracted positions once they are moved thereto. When the actuators 68, 88 are moved to their extended positions, conventional springs (not shown) are preferably used to maintain their positions in the extended states. Therefore, when the actuators 68, 88 are in their retracted positions and held therein via the residual magnetism, a power pulse from the electronic control circuit is used to break the residual magnetism and to thereby extend the actuators 68, 88 via the springs into their extended positions. Conversely, when the actuators 68, 88 are in their extended positions and held therein by the springs, a power pulse from the electronic control circuit is used to force the actuators 68, 88 into their retracted positions against the force of the springs, and residual magnetism is used to keep the actuators 68, 88 in these positions.

In a highly preferred embodiment of the present invention, the electronic control circuit just described contains at least two power sources for the actuators 68, 88 in the latch assembly 10. These power sources can comprise any conventional power sources including, without limitation, capacitors, batteries, alternators, generators and vehicle electrical systems. For illustrative purposes only, a first power source is described herein as a battery and a second power source is described as a capacitor. During normal operation when the latch assembly 10 is powered continuously by the battery 120, each capacitor 124 is continuously charged. Each capacitor 124 stores sufficient energy to break the residual magnetism of the electromagnetic solenoids 68, 88. In the event of total power failure, the control circuit can automatically discharge the capacitors 124 to cause the actuators 68, 88 to unlock the latch assembly 10. The latch assembly 10 can be completely unlocked or partially unlocked upon power failure. When the latch assembly 10 is used on a vehicle door, only the portion of the latch assembly 10 actuated by an inside door handle will be unlocked. This configuration enables the vehicle occupant to exit the vehicle while maintaining security against unauthorized entry. Alternatively, the user can unlock the latch assembly 10 manually (e.g., using a switch) using energy stored by the capacitors. Further, it may instead be desirable to have one capacitor for each actuator 68, 88 with enough charge to place the solenoids 68, 88 in their retracted positions. Therefore, even with power disconnected from the latch assembly 10, there exists sufficient charge in the control circuit to lock the latch assembly 10 (either under command of the user or automatically by the control circuit). With multiple capacitors for each actuator 68, 88, a preferred embodiment of the present invention has one capacitor for each actuator 68, 88 with sufficient energy to place the actuator 68, 88 in its locked position and another capacitor for each actuator 68, 88 with sufficient energy to place the actuator 68, 88 in its unlocked position.

The electronic control circuit is preferably also provided with a conventional electrical characteristic sensing circuit for detecting the power supplied to the electronic control circuit. Such sensing circuits (e.g., voltage or current sensing circuits) are well known to those skilled in the art and are therefore not described further herein except for the generalized example shown in FIG. 15. When the sensing circuit detects a change in an electrical characteristics beyond a predetermined level such as low voltage or current level, or loss of power such as due to a disconnected or failed power source, the control circuit preferably generates a signal to the actuators to place them in their unlocked positions to unlock the latch assembly 10. Alternately, (though not preferred) when the sensing circuit detects the change, the control circuit can instead enable a control or button that can be actuated by the user to unlock the latch.

Figure 15:
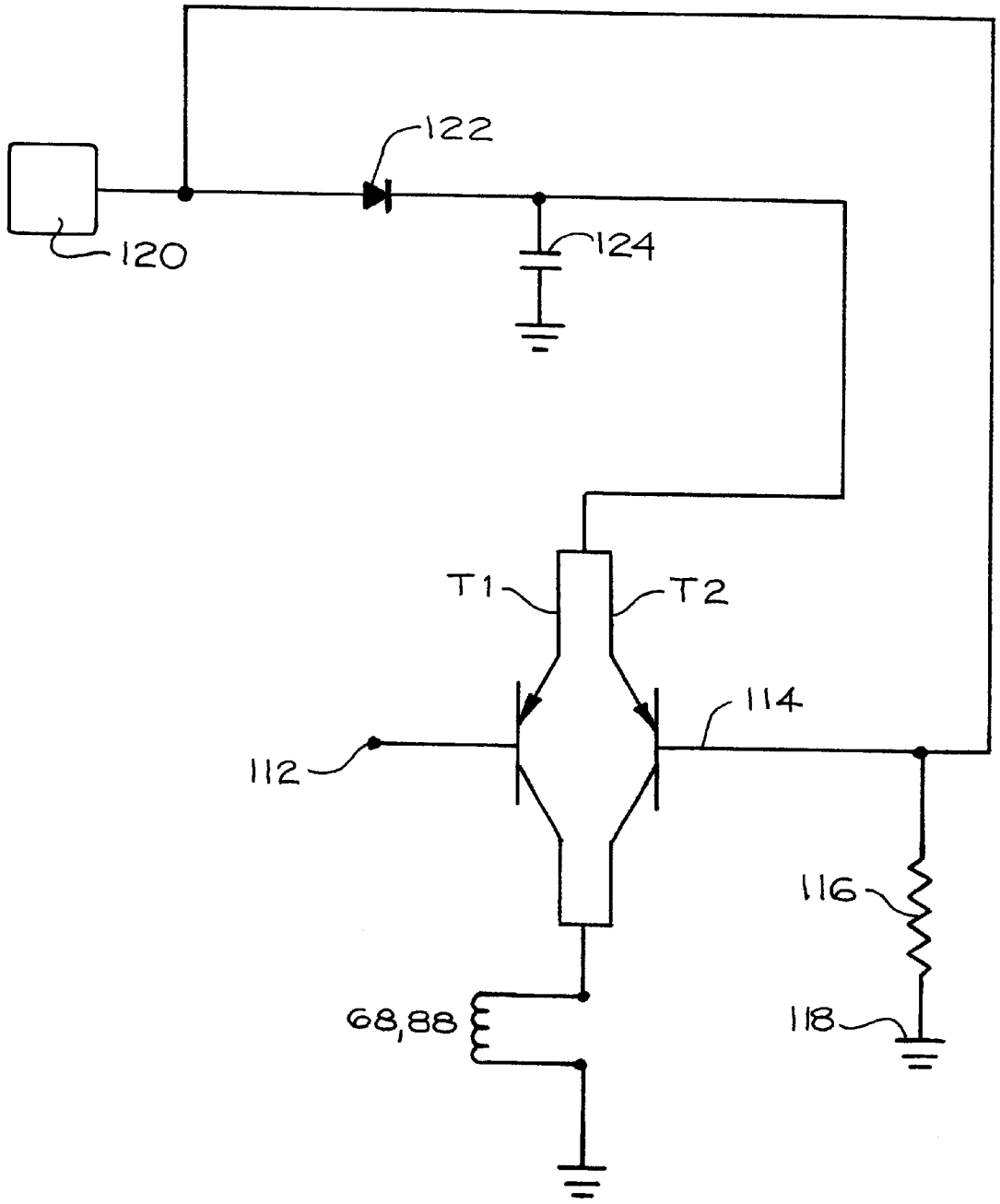
FIG. 15 is a schematic diagram of a control circuit for the latch assembly of the present invention according to a preferred embodiment of the present invention.

An exemplary automatic unlocking circuit 110 for unlocking the latch assembly 10 is shown in FIG. 15. It will be apparent to one of ordinary skill in the art that a wide variety of circuits and components different than that illustrated in FIG. 15 and described below can be used equivalently. T1 and T2 are two PNP-type transistors connected in parallel. During typical operation, a delatching pulse applied at node 112 activates transistor T1 and preferably comprises a conventional controlled voltage pulse sufficient to delatch the solenoid 68, 88.

Transistor T2's base 114 is preferably connected to a resistor 116 connected to ground 118, and is also preferably connected to a 12 volt battery or other voltage source 120 such as in a conventional vehicle electrical system.

When 12 volts D.C. from the battery 120 is present, T2 is non-conducting and T1 is non-conducting unless pulsed to ground 118. The diode 122 keeps the capacitor 124 from discharging back to the rest of the system.

Accordingly, the capacitor 124 only discharges when one of the battery's electrical characteristics such as voltage level falls below a predetermined level. When this occurs, the base of T2 approaches ground 118. Therefore, T2 turns on fully and the capacitor 124 can discharge through T2 and send a release pulse through the solenoid 68, 88 thereby delatching the solenoid 68, 88 and unlocking the latch assembly 10.

In addition to all of the preferred embodiments previously described, it will be appreciated by one having ordinary skill in the art that the particular arrangement and operation of the actuators 68, 88 described above for the most preferred embodiment of the present invention can take a number of other forms within the spirit and scope of the present invention. For example, the residual magnetism exerted upon the actuators 68, 88 to keep them in their retracted positions can instead be exerted upon the actuators 68, 88 to keep them in their extended positions, and the springs keeping the actuators 68, 88 in their extended positions can instead be used to keep the actuators 68, 88 in their retracted positions (i.e., the opposite solenoid arrangement as that described above). In such an arrangement, the latch assembly can operate in a similar manner as described above, with a dual power source (e.g., battery and capacitor), with a sensing circuit, and/or with similar electronic circuitry. Such an arrangement can be particularly useful in applications where it is desirable to place or keep the latch assembly 10 in its locked state in the event of power loss. When power is lost, interrupted, or otherwise changed in a predetermined manner, the sensing circuit preferably triggers the actuators to retract using the dual power source arrangement described above, thereby placing the latch assembly in its locked state.

Other embodiments of the present invention employ conventional solenoids using permanent magnets. These magnets retain the solenoid's armatures in both extended and retracted positions as is well known in the art. Other well known systems and elements can be used to achieve the function of the capacitors described above, and well known mechanical and electrical systems and elements can be used as alternatives to the springs and residual magnetism employed to control the positions of the actuators 68, 88.

As indicated above, many alternatives to the use of electromagnetic solenoids for the actuators 68, 88 exist and are well-known to those skilled in the art. For example, the actuators can each be a rack and pinion assembly. As another example, the actuators can each be a motor turning a worm gear that meshes with an element (e.g., a threaded pin) to push and pull the element toward and away from the control elements 52, 53. The element can instead be a wheel having teeth meshing with the worm gear. In such an arrangement, rotation of the worm gear causes rotation of the wheel. A pin or rod attached to the circumference of the wheel can then be moved toward or away from the control elements 52, 53 via rotation of the wheel. All other well known mechanisms for quickly extending and retracting a pin or other engagement element are useful with and fall within the spirit and scope of the present invention.

Figure 6:
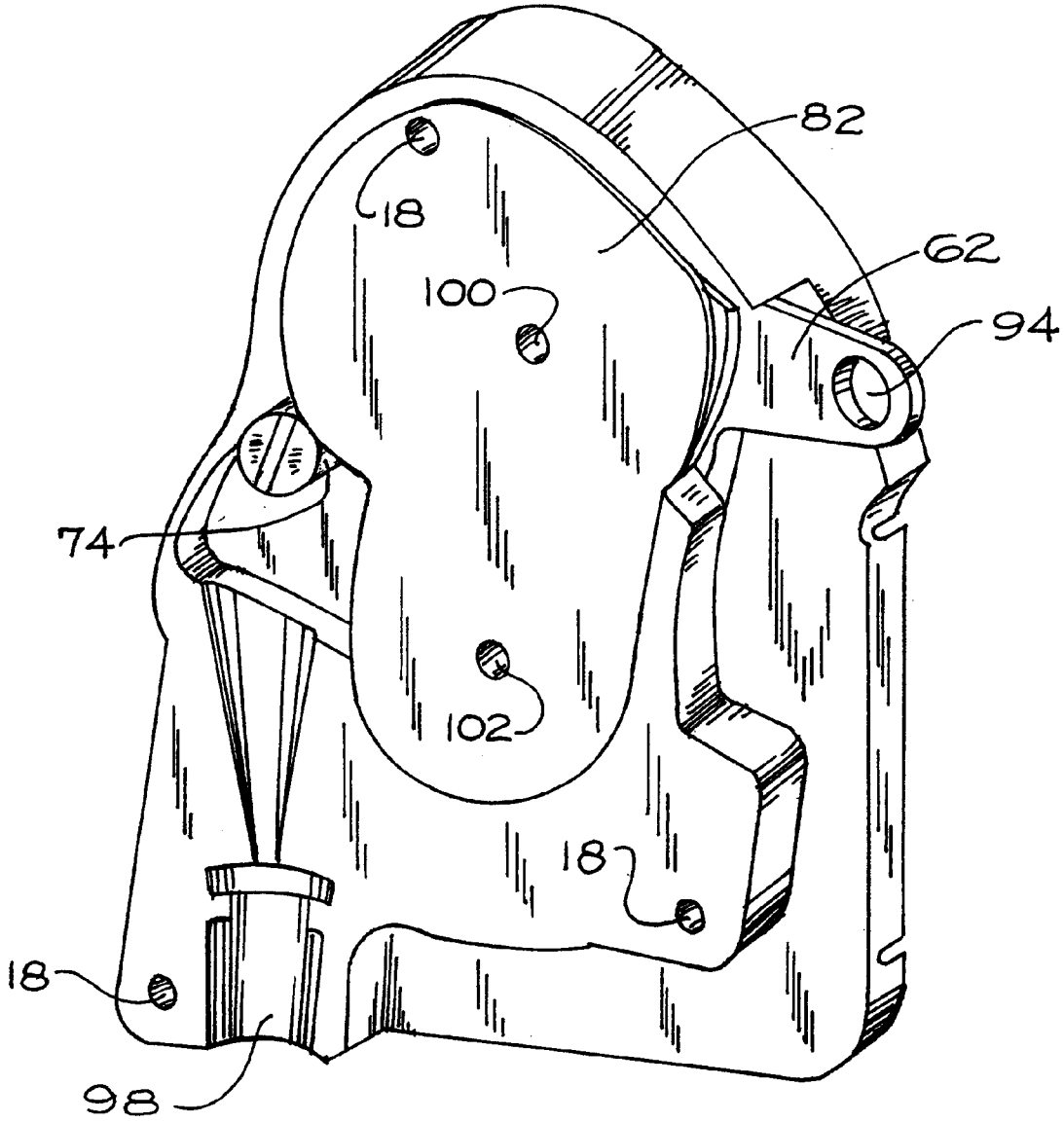
FIG. 6 is a front perspective view of the latch mechanism shown in FIGS. 1–5, with the front cover removed.
Figure 7:
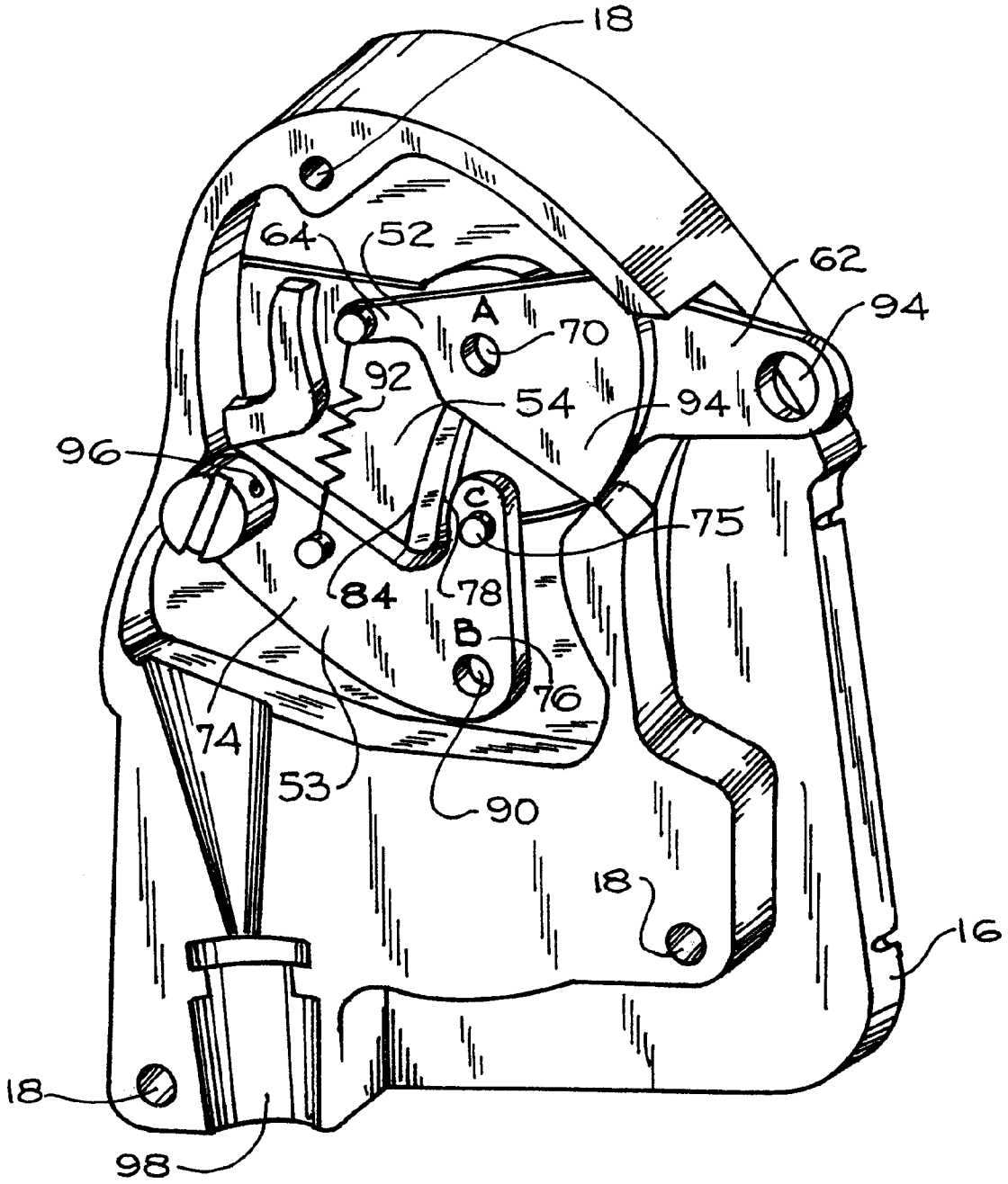
FIG. 7 is a front perspective view of the latch mechanism shown in FIGS. 1–6, with the front cover and the cover plate removed, and showing the control levers and the pawl of the latch mechanism.
Figure 8:
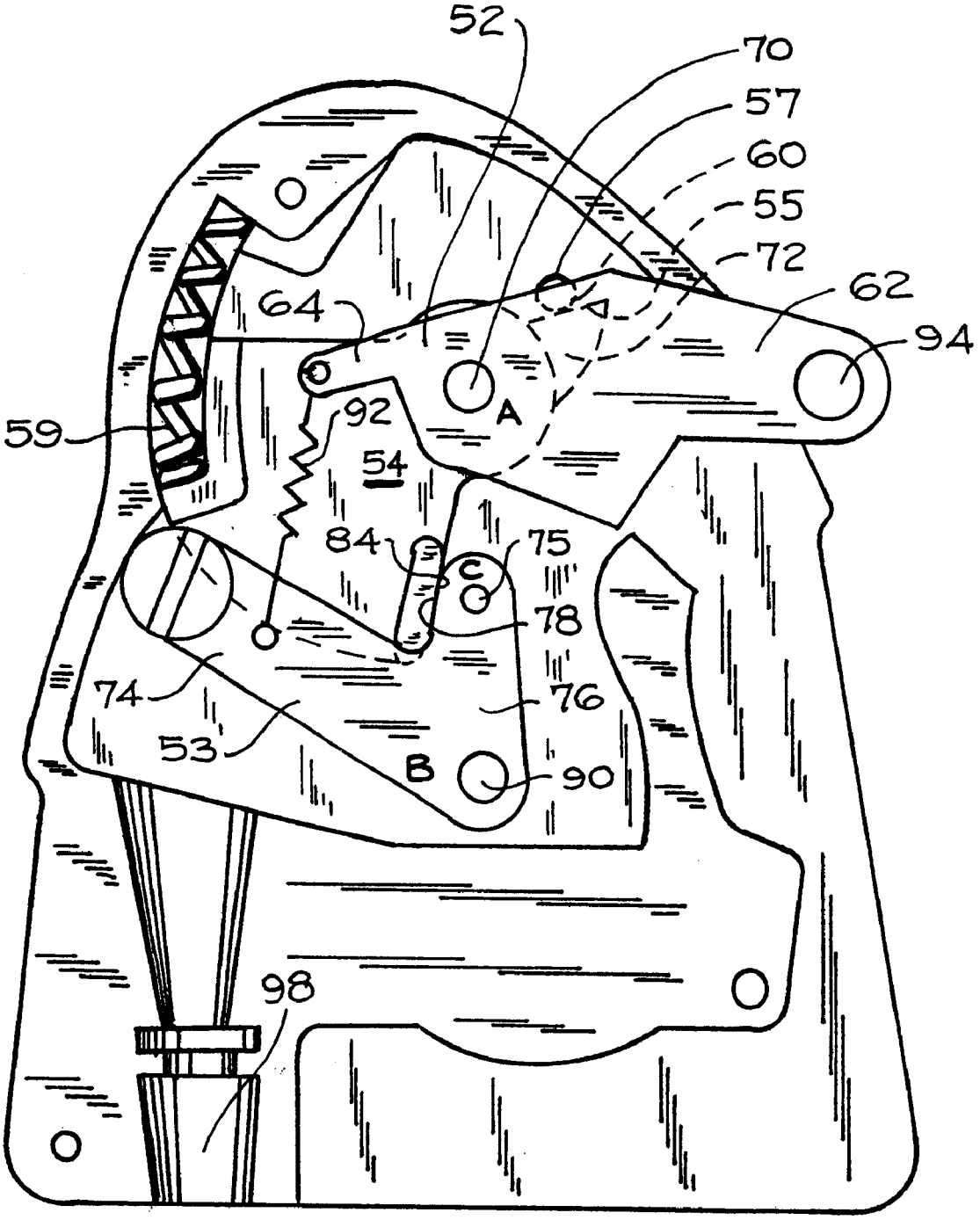
FIG. 8 is a front elevational view of the latch mechanism shown in FIG. 7, with both the right and left control elements in their unactuated positions.

The actuators 68, 88 in the preferred embodiment of the present invention are preferably contained and substantially enclosed in the cover 12 and are preferably encapsulated therein by the cover plate 82 as best shown in FIGS. 4–6. The cover plate 82 is preferably provided with apertures 100, 102 for receiving the pins 66, 86, respectively, which extend beyond the cover plate 82 when in their extended positions to interact with the control elements 52, 53. The cover plate 82 also helps to protect the actuators 68, 88 from debris, dirt, etc., managing to enter the latch assembly 10 between the cover plate 82 and the housing 16, and helps to control movement of the pins 66, 86.

The pins 66, 86 are preferably mounted to or integral with the armatures of the actuators 68, 88. It will be apparent to one of ordinary skill in the art that the pins 66, 86 need not necessarily be mounted to or be part of the armatures. Instead, the pins can be mounted to pin plates 104, 106 as shown in the figures. Further, depending largely upon the type of actuator used, the pins 66, 86 can extend within the actuators 68, 88 which directly control the movement of the pins 66, 86 into and out of the apertures 100, 102 in the cover plate 82. Other pin arrangements will be recognized by those skilled in the art and are encompassed by the present invention.

In operation, the user of the preferred embodiment of the present invention described above has the ability to select from four locking modes of the latch assembly 10: unlocked, locked, child locked, and dead locked. In the unlocked mode, the electronic control circuit described above preferably sends a signal or signals to both actuators 68, 88 to place them in their extended positions in which the pins 66, 86 are also in their extended positions. The pins 66, 86 thus interact with the control elements 52, 53 to control the control elements 52, 53 to pivot about pivot points A and B. By pivoting about pivot points A and B, the control elements 52, 53 are able to move the pawl 54 and release the ratchet 22 to unlatch the latch assembly 10 when the control levers 52, 53 are actuated by a user. In this unlocked state, actuation of either control lever 52, 53 (e.g., via the inside door handle or the outside door handle of a vehicle door) will therefore unlatch the latch assembly 10.

In the locked mode, the electronic control circuit preferably sends a signal or signals to one of the two actuators 68, 88 to place it in its retracted position and a signal or signals to the other actuator 88, 68 to place it in its extended position. In the case of the latch assembly 10 illustrated in the figures, the upper actuator 68 controls the position of the upper pin 66 which is either engaged or disengaged with the right control element 52, while the lower actuator 88 controls the position of the lower pin 86 which is either engaged or disengaged with the left control element 53. While the control elements 52, 53 can be connected directly to door handles, the right control element 52 is preferably coupled by a linking element to the outside door handle while the left control element 53 is preferably coupled by a linking element to the inside door handle. The linking elements can comprise conventional linkages, rods, cables, linear actuators, rotary actuators and the like for transmitting torque, tensile forces and/or compressive forces. Thus, for the arrangement just described, the upper actuator 68 controls the locked and unlocked states of the outside door handle, and the lower actuator 88 controls the locked and unlocked states of the inside door handle.

Prior to describing the child locked mode of the latch assembly 10, it should be noted that the term "child locked" is used herein for mode identification purposes only. The term itself is not intended to explicitly or implicitly define the arrangement and operation of the latch assembly 10. In general use of the term, "child locked" typically means that the inside door handle of a vehicle door is not operable to unlatch the door, and does not provide any information about the operability of the outside door handle. However, for mode identification purposes herein, the term "child locked" means that the inside door handle is inoperable and the outside door handle is operable.

In the child locked mode for the particular arrangement of the latch assembly 10 described above, the upper actuator 68 is preferably in an extended position (controlled by the electronic control circuit) and the upper pin 66 is engaged with the right control element 52. The right control element 52 is therefore in its unlocked state. The lower actuator 88 is preferably in a retracted position (also controlled by the electronic control circuit) and the lower pin 86 is disengaged from the left control element 53. The left control element 53 is therefore in its locked state. Actuation of the inside door handle then causes the left control element 53 to move, but not in a manner imparting motive force to the pawl 54 to unlatch the latch assembly 10. Actuation of the outside door handle causes the right control element 52 to pivot about pivot point A (engaged via the upper pin 66), thereby moving the pawl 54 to unlatch the latch assembly 10. Therefore, in the child locked mode, the latch assembly 10 can be unlatched by the outside door handle but not by the inside door handle. It should be noted, however, that the outside door handle can be put into a locked state independent of the child locked mode.

In the dead locked mode, the electronic control circuit preferably sends a signal or signals to both actuators 68, 88 to place them in their retracted positions in which the pins 66, 86 are also in their retracted positions. The pins 66, 86 thus do not interact with the control elements 52, 53, leaving the control elements 52, 53 to pivot about the abutment post 60 and the rotation peg 75, respectively. By pivoting about the abutment post 60 and the rotation peg 75, the control elements 52, 53 are unable to move the pawl 54 and release the ratchet 22 to unlatch the latch assembly 10 when the control levers 52, 53 are actuated by a user. In this dead locked state, actuation of either control lever 52, 53 (e.g., via the inside door handle or the outside door handle of a vehicle door) will therefore not unlatch the latch assembly 10.

It will be appreciated by one having ordinary skill in the art that the principles of the present invention can be practiced with latch assemblies which are arranged in a significantly different manner than the preferred embodiment of the latch assembly 10 described above and illustrated in the drawings. Specifically, the connection of the upper actuator 68, upper pin 66, and right control element 52 to an outside door handle and the connection of the lower actuator 88, lower pin 86, and left control element 53 to an inside door handle can be reversed (i.e., the upper actuator 68 controlling the locked and unlocked states for the inside door handle and the lower actuator 88 controlling the locked and unlocked states for the outside door handle). In fact, the use of two actuators 68, 88, two pins 66, 86, and two control elements 52, 53 is only a preferred embodiment. More or fewer actuator, pin, and control element sets can be used depending upon the number of handles (or other user-actuated elements) desired to control the various locking modes of the latch assembly 10. For example, one set can be used if the door only has one handle for latching and unlatching the latch assembly 10. Also, multiple handles (or other user-actuated elements) can be coupled to the same control lever, if desired. In such a case, an inside and an outside handle can operate always in the same mode: locked or unlocked.

The cover 12, housing 16, and cover plate 82 of the latch assembly 10 are preferably made of plastic. However, the cover 12, the housing 16, and the cover plate 82 can be made from any number of other materials, such as steel, aluminum, iron, or other metals, urethane, fiberglass or other synthetic materials, composites, refractory materials such as glass, ceramic, etc., and even relatively unusual materials such as wood or stone. Depending upon the type of material used, the cover 12 can be made in a number of manners, such as via a heat and/or pressure sintering process, casting, injection or other molding, curing, extruding, stamping, pressing, firing, welding, etc. The materials and methods just described are well known to those skilled in the art and are encompassed by the present invention.

The rear mounting plate 14, ratchet 22, and pawl 54 are preferably made of steel, and the right and left control levers 52, 53 are preferably made of a castable or moldable material such as zinc or plastic. However, these elements can also be made from a variety of other materials including those noted by way of example in the preceding paragraph. Preferably, the ratchet spring 40, the pawl spring 59, the control element spring 92, and the actuator springs (not shown) are each helical springs made of spring steel. However, one having ordinary skill in the art will recognize that any type of bias member capable of exerting motive force against the relevant elements can instead be used. Such other bias members include, without limitation, an elastomeric material such as rubber, urethane, etc. capable of storing and releasing an amount of force under pressure, magnets, fluid or gas-actuated diaphragms pressing against or pulling the device to be moved, vacuum or suction devices acting upon the element desired to be moved, electromagnets, electrical circuits or elements capable of generating a biasing force, etc. Of course, other spring types (such as conventional coil, torsion, or leaf springs) made from different spring materials can be used in lieu of the helical springs to accomplish the same functions. Although the manners in which the other types of bias members are fastened within the latch assembly can be quite different to create the same or similar biasing force described above, such other types of bias members fall within the spirit and scope of the present invention. The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, although the present invention can be employed with excellent results in vehicle doors, the present invention can be used in any application where one body is releasably latched to another body via a movable element (e.g., a ratchet) having a latched state and an unlatched state controlled by interference caused directly or indirectly by one or more control elements 52, 53. Such applications can be in non-vehicle environments and can be virtually any size (e.g., from large canal door latches to miniature device latches). The moveable element need not necessarily be a ratchet or even rotate about a pivot point, but at least is selectively held in latched and unlatched states by either a pawl or like device or directly by a control element 52, 53.

In light of the above, it should be noted that the particular device used to capture the striker 20 or other element captured by the latch assembly 10 can be significantly different than that described above and illustrated in the drawings. Though important to operation of the latch assembly 10, other elements and mechanisms beside a pivotable ratchet and spring arrangement can be used to interact either with the pawl 54 or directly with the control lever(s) 52, 53 if a pawl 54 is not used. One skilled in the art will recognize that it is possible to eliminate the pawl 54 in alternative embodiments of the present invention and to design the control lever(s) to ride upon and limit the rotation of the ratchet 22 in much the same way as the pawl 54. In such alternative embodiments, the inventive principles herein are still employed: moving a control element in one manner when engaged by an engagement element (e.g., a pin controlled by a solenoid) and in another manner when disengaged. In one manner, the control element moves to directly or indirectly release the ratchet 22 and in another manner, movement of the control element does not directly or indirectly release the ratchet 22. Where a pawl 54 is employed, sole rotational movement of the pawl 54 is not a requirement. For example, the pawl 54 can be shifted or translated against spring force in one direction when the control levers act upon the pawl 54 in their unlocked states and be unaffected when the control levers are in their locked states. Even a combined translation and rotation of the pawl 54 is possible when actuated by the control levers. Also, it should be noted that multiple pawls can be used, if desired, to interact with different stop surfaces of the ratchet 22 in more complex latch assemblies.

In addition to the variations and alternatives just discussed, the control elements 52, 53 can also be significantly different than described above and illustrated in the figures. The right and left control elements 52, 53 are disclosed herein as being generally straight and generally L-shaped, respectively. However, it is possible that both elements can be made identical (and placed on top of one another with their linkage ends 62, 74 adjacent to one another, placed in a similar orientation to that shown in the figures, etc.). Also, the control elements 52, 53 can be virtually any shape, as long as the control elements 52, 53 move in a first manner to directly or indirectly release the ratchet 22 as described above and to not do so when moving in a second manner, the manners of movement being controlled by engagement with the pins 66, 86.

As described above and illustrated in the figures, the control elements 52, 53 are preferably selectively engaged for rotation about pivot points A and B, respectively, by pins 66, 86. The pins 66, 86 are controlled by the actuators 68, 88 to be inserted into and retracted from the apertures 70, 90 in the control elements 52, 53. This relationship is only one of a number of different engagement relationships possible in the present invention. Specifically, the pins 66, 86 are only one type of engagement element performing the function of controlling the movement of the control elements 52, 53 in a particular manner when engaged (e.g., by allowing only rotation of the control elements 52, 53 about pivot points A and B). The present invention resides not in the particular type or shape of engagement element, but in the control of the control elements 52, 53 when the pins 66, 86 are in their engaged states. Therefore, one having ordinary skill in the art will recognize that the location of the pins 66, 86 and the apertures 70, 90 can be reversed, with pins in the control elements 52, 53 fitting into apertures in the plates 104, 106 or actuators 68, 88.

Engagement of the control elements 52, 53 by the actuators 68, 88 can also be performed for example, by bumps in the control elements 52, 53 fitting into dimples in the pin plates 104, 106 or actuators 68, 88 (or vice versa), by one or more teeth in the control elements 52, 53 and in the pin plates 104, 106 or actuators 68, 88 meshing together when engaged, by a magnetic or electromagnetic connection established between the pin plates 104, 106 or actuators 68, 88 and the control elements 52, 53, etc. All such alternatives to the pin and aperture arrangement in the preferred embodiment of the present invention share the inventive principle of using an actuator to engage the control elements 52, 53 for controlling their movement as described above. It should be noted that the particular location of the pins, teeth, bumps, or other engagement elements need not necessarily be between the actuators 68, 88 and the control elements 52, 53. Instead, the engagement elements can be located between the control elements 52, 53 and the housing 16, if desired. For example, the pins, teeth, bumps, or magnets can be located on the housing 16 normally disengaged from the control elements 52, 53 when the actuators 68, 88 are in their retracted positions. When the actuators 68, 88 are extended, they can push the control elements 52, 53 into engagement with the pins, teeth, bumps, or magnets on the housing 16 to thereby engage the control elements 52, 53 for a particular motion (as the pins 66, 86 in the preferred embodiment described above do).

The latch assembly 10 of the present invention as disclosed herein employs an engagement element or elements such as pins 66, 86, teeth, bumps, or magnets engaging with an element or elements such as apertures 70, 90, teeth, dimples or magnets in the control elements 52, 53 (or vice versa). However, one having ordinary skill in the art will recognize that the engagement elements need not interact by inserting one engagement element into another (such as a pin 66, 86 into an aperture 70, 90 in the control elements 52, 53). Instead, the engagement elements can simply be actuated to provide guidance surfaces to control the movement of the control elements 52, 53 when actuated. For example, in the case of the pin and aperture arrangement of the preferred embodiment, the pins 66, 86 need not be inserted into apertures in the control elements 52, 53. Instead, the pins 66, 86 can be inserted alongside the control elements 52, 53 so that when the control elements 52, 53 are actuated by a user, the pins 66, 86 guide the control elements 52, 53 along a particular path that is different than that taken by the control elements 52, 53 when the pins 66, 86 are retracted. The control elements 52, 53 need not therefore be limited for solely rotational movement (such as in the preferred embodiment of the present invention) in either state. In fact, movement of the control elements 52, 53 in the extended and retracted states of the pins 66, 86 can be purely translational or be a combination of rotation and translation. A broad aspect of the present invention resides not necessarily in the specific rotation, translation, or combined rotation and translation of the control elements 52, 53 in either their locked or unlocked states, but rather in a path of control element motion imparting movement to the pawl 54 (if used) in one actuator state and a path of control element motion not imparting such movement in a second actuator state. Because the two paths of motion are determined by the placement of the pins 66, 86 and the shape of the control elements 52, 53, the path imparting motion and the path not imparting motion need not correspond to the extended and retracted positions of the pins 66, 86. The path imparting motion and the path not imparting motion can correspond instead to the retracted and extended positions of the pins 66, 86, as desired.

The latch assembly 10 can also include a manual override device coupled to at least one of the control element 52, 53, the pawl 54 and the actuator 68, 88. The manual override operates to change the states or modes of the latch assembly 10 in a supplemental manner to the manners previously described. The manual override can comprise a wide variety of manually actuated mechanical or electronic devices, but preferably comprises a lock. It will be apparent to one of ordinary skill in the art that the coupling of the manual override to the latch assembly 10 will vary depending upon the particular manual override selected. For example, where the manual override comprises a cylinder lock, any of the previously described linking elements can be used satisfactorily to couple the manual override to the latch assembly 10. In one highly preferred embodiment, the cylinder lock includes a projection for driving a mechanical linkage that is connected directly to the engagement elements of the latch assembly 10, such as to the linkage end 62 of the right control lever 52. Alternatively, an electronic manual override such as an electronic lock can be electronically coupled to an electronic actuator, or can be used to actuate a mechanical element or linkage.

Figure 16:
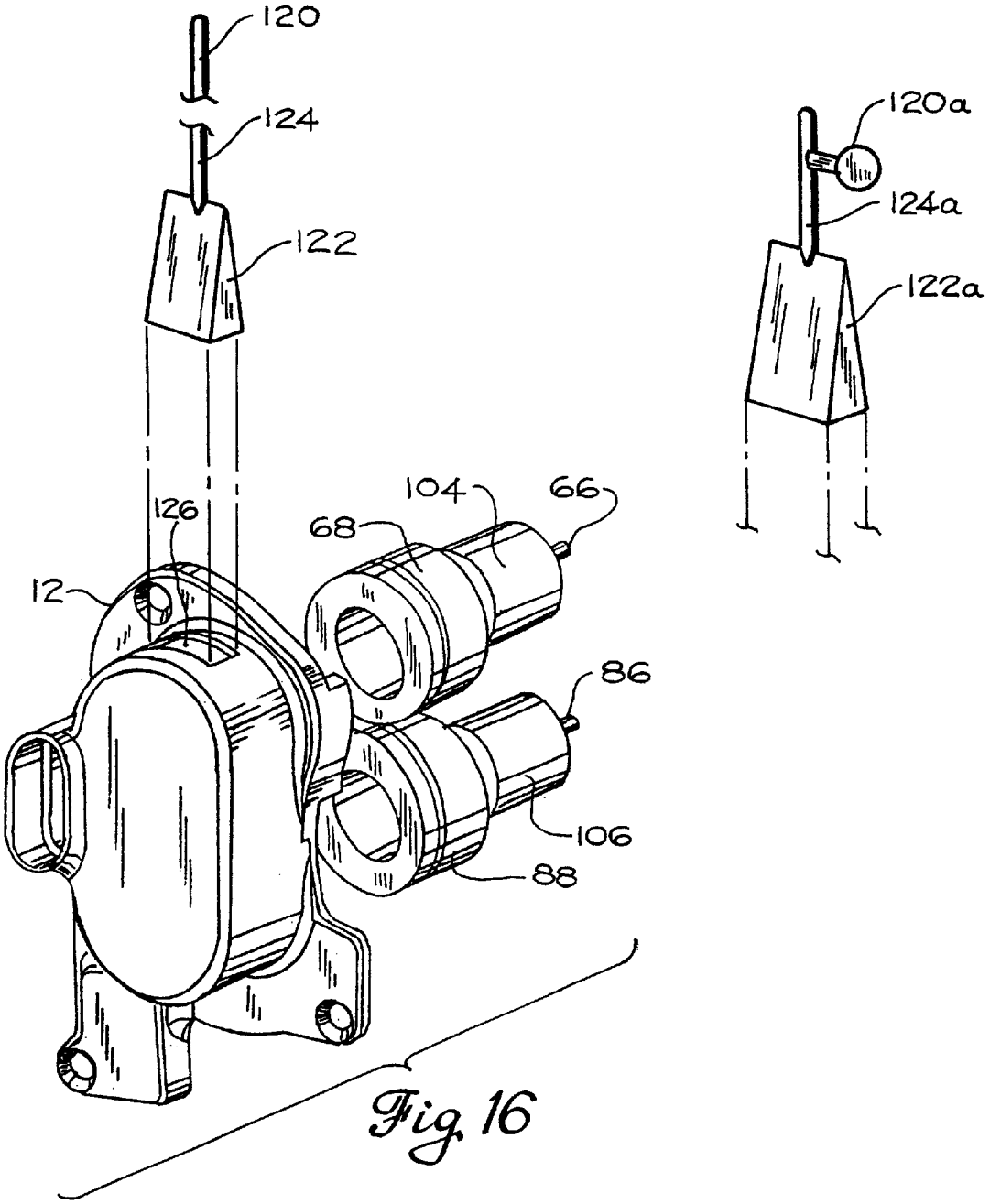
FIG. 16 is a exploded perspective view of a portion of the latch assembly with a manual override according to a preferred embodiment of the present invention.

Two manual override assemblies are illustrated by way of example in FIG. 16. On the left in FIG. 16 is a conventional user-activated lock pin 120 accessible from within the vehicle and used to manually override the latch assembly 10. The lock pin 120 can be connected to a wedge shaped element 122 inserted within the latch assembly 10 as shown by the dashed lines. Specifically, a rod 124 or other conventional linking member can extend from the lock pin 120, into an aperture 126 in the cover 12, and to the wedge shaped element 122. As such, lifting the lock pin 120 will move the wedge shaped element 122 in an upward direction as viewed in FIG. 16, thereby causing the wedge shaped element 122 to act upon the pin 66 to push it into its unlocked state (note that the rear end of the pin 66 preferably extends through and past the actuator 68 when in its fully retracted position). Depressing the lock pin 120 will permit the pin 66 to retract, when actuated, to place the pin 66 in its locked state again.

Another type of manual override is also shown by way of example in FIG. 16. Where, as preferred, the manual override is operated by a cylinder lock 120*a*, the cylinder lock 120*a* can be connected to a wedge shaped element 122*a* inserted in the latch assembly 10. Like the manual override 120, 122, 124 described above, a rod 124a or other conventional linking member can extend from the cylinder lock 120*a* into the aperture 126 in the cover 12, and to the wedge shaped element 122*a*. When the cylinder lock 120*a* is turned by an authorized user, the rod 124*a* and the wedge shaped element 122*a* act in a similar manner as described above to place the pin 66 in its locked and unlocked states. The manual overrides illustrated in FIG. 16 are shown only by way of example. One skilled in the art will recognize that many other manual override devices and systems can instead be used to achieve the same result. Also, a manual override can be coupled to both pins 66, 86 or just to the lower pin 86. Multiple manual override devices can also be used, if desired, to operate the same pin. It will be apparent to one of ordinary skill in the art that still other manual overrides can be used without departing from the present invention.

I claim:

1. A latch assembly, comprising:

a control lever having
a first pivot point and
a second pivot point;

an engagement element having an extended position with respect to the control lever in which the engagement element is extended toward and coupled to the control lever, and a retracted position with respect to the control lever in which the engagement element is decoupled and withdrawn from the control lever, the control lever being pivotable about the first pivot point when the engagement element is in the extended position and pivotable about the second pivot point when the engagement element is in the retracted position;

an actuator coupled with the engagement element and having an engaged position in which the engagement element is coupled with the control lever and a disengaged position in which the engagement element is substantially released from the control lever; and a ratchet responsive to actuation of the control lever when the engagement element is coupled to the control lever and non-responsive to actuation of the control lever when the engagement element is decoupled from the control lever.

2. The latch assembly as claimed in claim 1, wherein the actuator comprises at least one of a solenoid, an electric motor, a hydraulic cylinder, a pneumatic cylinder, a vacuum actuator and a manually actuated device.

3. The latch assembly as claimed in claim 1, wherein the engagement element is a pin adapted to mate with the control lever.

4. The latch assembly as claimed in claim 3, wherein the pin is coupled to the actuator for connection to and disconnection from the control lever at the first pivot point.

5. The latch assembly as claimed in claim 3, wherein the control therein for receiving the pin when the actuator is in the engaged position.

6. The latch assembly as claimed in claim 1, wherein the control lever has an end for receiving force applied to the control lever externally of the latch assembly for rotating the control lever.

7. The latch assembly as claimed in claim 1, further comprising a pawl located adjacent to the control lever and the ratchet, the pawl positioned substantially within the latch assembly to contact and be moved by the control lever when the control lever is pivoted about the first pivot point.

8. The latch assembly as claimed in claim 7, wherein the pawl has a first pawl position beside the ratchet and a second pawl position disposed from the ratchet by the control lever.

9. The latch assembly as claimed in claim 8, further comprising a pawl spring biasing the pawl into the first pawl position and away from the second pawl position.

10. The latch assembly as claimed in claim 8, wherein the pawl is in an interfering relationship with rotation of the ratchet when the pawl is in the first pawl position and is free from interference with rotation of the ratchet when the pawl is in the second pawl position.

11. The latch assembly as claimed in claim 7, wherein both the pawl and the control lever are coupled by the engagement element for rotation when the engagement element is coupled to the control lever.

12. The latch assembly as claimed in claim 7, wherein the pawl has a bearing surface and the control lever has a bearing surface, the bearing surfaces of the pawl and the control lever being in abutting and force-transmitting relationship when the engagement element is coupled to the control lever.

13. The latch assembly as claimed in claim 7, wherein the control lever is substantially incapable of transmitting motive force to the pawl when the engagement element is decoupled from the control lever.

14. The latch assembly as claimed in claim 7, wherein rotation of the control lever is substantially free from interference with the pawl when the engagement element is decoupled from the control lever.

15. The latch assembly as claimed in claim 7, wherein the pawl has a cam surface and wherein the control lever has a cam surface positioned to ride upon the cam surface of the pawl when the engagement element is coupled to the control lever.

16. The latch assembly as claimed in claim 1, further comprising:

a second control lever having
a third pivot point and
a fourth pivot point;

a second engagement element having an extended position with respect to the second control lever in which the engagement element is extended toward and coupled to the control lever, and a retracted position with respect to the second control lever in which the engagement element is decoupled and withdrawn from the control lever, the second control lever being pivotable about the third pivot point when the second engagement element is in its extended position and pivotable about the fourth pivot point when the second engagement element is in its retracted position;

a second actuator coupled with the second engagement element and having an engaged position in which the second engagement element is coupled with the second control lever and a disengaged position in which the second engagement element is released from the second control lever;

the ratchet responsive to actuation of the second control lever when the second engagement element is coupled to the second control lever and non-responsive to actuation of the second control lever when the second engagement element is decoupled from the second control lever.

17. The latch assembly as claimed in claim 16, wherein the first control lever and the second control lever each have a connection point for connecting externally extending linking elements thereto, the first and second control levers being pivotable via force exerted upon the connection point of each lever by the externally extending linking elements.

18. The latch assembly as claimed in claim 16, further comprising at least one lever bias element biasing at least one of the control levers toward the other control lever.

19. The latch assembly as claimed in claim 16, further comprising a lever bias element comprising a lever bias spring connected at one end to the first control lever and at another end to the second control lever to bias the control levers toward each other.

20. A latch assembly, comprising:

a control element having a pivot point;

an actuator having a first position in which the control element is engaged by the actuator and a second position in which the control element is disengaged from the actuator;

an engagement element movable by the actuator between an extended position relative to the control element in which the engagement element is extended toward and coupled to the control element, and a retracted position relative to the control element in which the engagement element is decoupled and withdrawn from the control element, the control element actuatable for pivotal movement about the pivot point when engaged by the actuator and actuatable for different movement when disengaged from the actuator; and a ratchet arranged and configured for rotation responsive to motion of the control element when the control element is engaged by the actuator and for non-rotation when the control element is disengaged from the actuator, wherein the pivot point is a first pivot point, and wherein the control element is pivotable about a second pivot point when the control element is disengaged from the actuator.

21. The latch assembly as claimed in claim 20, wherein the control element is capable of exerting force resulting in motion of the ratchet when the control element is engaged by the actuator in the first position, the control element being incapable of exerting force sufficient to move the ratchet into an unlatched state when the control element is disengaged from the actuator in the second position.

22. The latch assembly as claimed in claim 20, further comprising a pawl located adjacent to the control element and the ratchet, wherein the control element is capable of exerting force sufficient to move the pawl from a position in which the pawl interferes with movement of the ratchet to a position in which the pawl does not interfere with movement of the ratchet when the control element is engaged by the actuator in the first position.

23. A latch assembly, comprising:

a control element having a pivot point;

an actuator having a first position in which the control element is engaged by the actuator and a second position in which the control element is disengaged from the actuator;

an engagement element movable by the actuator between an extended position relative to the control element in which the engagement element is extended toward and coupled to the control element, and a retracted position relative to the control element in which the engagement element is decoupled and withdrawn from the control element, the control element actuatable for pivotal movement about the pivot point when engaged by the actuator and actuatable for different movement when disengaged from the actuator; and a ratchet arranged and configured for rotation responsive to motion of the control element when the control element is engaged by the actuator and for non-rotation when the control element is disengaged from the actuator, wherein the engagement element is coupled with the control element when the engagement element is in its extended position and is uncoupled from the control element when the engagement element is in its retracted position withdrawn from the control element; and wherein the actuator is a solenoid.

24. A latch assembly, comprising:

a first control element having a pivot point;

a first actuator having a first position in which the first control element is engaged by the first actuator and a second position in which the first control element is disengaged from the first actuator;

a first engagement element movable by the first actuator between an extended position relative to the first control element in which the first engagement element is extended toward and coupled to the first control element, and a retracted position relative to the first control element in which the first engagement element is decoupled and withdrawn from the first control element, the first control element actuatable for pivotal movement about the pivot point when engaged by the first actuator and actuatable for different movement when disengaged from the first actuator;

a second control element having a second pivot point;

a second actuator having a first position in which the second control element is engaged by the second actuator and a second position in which the second control element is released from the second actuator;

a second engagement element movable by the second actuator between an extended position relative to the second control element in which the engagement element is extended toward and coupled to the second control element, and a retracted position relative to the second control element in which the engagement element is decoupled and withdrawn from the second control element, the second control element actuatable for pivotal movement about the second pivot point when engaged by the second actuator and actuatable for different movement when disengaged from the second actuator; and a ratchet arranged and configured for rotation responsive to motion of the first control element when the first control element is engaged by the first actuator and for non-rotation when the first control element is disengaged from the first actuator, the ratchet being arranged and configured for rotation with the second control element when the second control element is engaged by the second actuator, and for non-rotation when both the first and second control elements are released from the first and second actuators, respectively.

25. A latch assembly, comprising:

a control lever having a pivot point, a cam surface, a first control lever state in which the control lever is pivotable about its pivot point, and a second control lever state in which motion of the control lever is different than motion of the control lever in the first control lever state;

an actuator having a first actuator state in which the control lever is placed in the first control lever state and a second actuator state in which the control lever is placed in the second control lever state;

an engagement element actuatable by the actuator, the engagement element extendible toward the control lever for engagement therewith in one of the actuator states and retractable from the control lever in another of the actuator states to a position in which the engagement element is withdrawn away from the control lever; and a pawl having a cam surface upon which the cam surface of the control lever abuts, the pawl being moveable between a latched position and an unlatched position via motion of the control lever cam surface against the pawl cam surface, wherein the control lever is pivotable about a second pivot point when the control lever is in its second control lever state.

26. A latch assembly, comprising:

a control lever having a pivot point, a cam surface, a first control lever state in which the control lever is pivotable about its pivot point, and a second control lever state in which motion of the control lever is different than motion of the control lever in the first control lever state;

an actuator having a first actuator state in which the control lever is placed in the first control lever state and a second actuator state in which the control lever is placed in the second control lever state;

an engagement element actuatable by the actuator, the engagement element extendible toward the control lever for engagement therewith in one of the actuator states and retractable from the control lever in another of the actuator states to a position in which the engagement element is withdrawn away from the control lever; and a pawl having a cam surface upon which the cam surface of the control lever abuts, the pawl being moveable between a latched position and an unlatched position via motion of the control lever cam surface against the pawl cam surface, wherein the actuator is a solenoid.

27. A latch assembly, comprising:

a control lever having a pivot point, a cam surface, a first control lever state in which the control lever is pivotable about its pivot point, and a second control lever state in which motion of the control lever is different than motion of the control lever in the first control lever state;

an actuator having a first actuator state in which the control lever is placed in the first control lever state and a second actuator state in which the control lever is placed in the second control lever state;

an engagement element actuatable by the actuator, the engagement element extendible toward the control lever for engagement therewith in one of the actuator states and retractable from the control lever in another of the actuator states to a position in which the engagement element is withdrawn away from the control lever; and a pawl having a cam surface upon which the cam surface of the control lever abuts, the pawl being moveable between a latched position and an unlatched position via motion of the control lever cam surface against the pawl cam surface, wherein the engagement element is positionable by the actuator in its extended position in which the actuator engages the engagement member with the control lever to define the second control lever state, the engagement element is a pin adapted to mate with the control lever, and the pin is coupled to the actuator for connection to and disconnection from the control lever at the pivot point.

28. A latch assembly, comprising:

a control lever having a first pivot point about which the control lever can pivot in a plane of motion; and a second pivot point;

an engagement element extendible toward and retractable from the plane of motion of the control lever, the engagement element extendible to an extended position in which the engagement element is coupled to the control lever and retractable to a retracted position in which the engagement element is de-coupled from the control lever, the control lever being pivotable about the first pivot point when the engagement element is in the extended position and pivotable about the second pivot point when the engagement element is in the retracted position;

an actuator coupled to the engagement element and having an engaged position in which the engagement element is coupled to the control lever and a disengaged position in which the engagement element is de-coupled from the control lever; and a ratchet responsive to actuation of the control lever when the engagement element is coupled to the control lever and non-responsive to actuation of the control lever when the engagement element is de-coupled from the control lever.

* * * * *